US007594662B2

(12) United States Patent
Fukazawa et al.

(10) Patent No.: US 7,594,662 B2
(45) Date of Patent: Sep. 29, 2009

(54) GIFT ACQUISITION GAME DEVICE

(75) Inventors: Mitsuharu Fukazawa, Tokyo (JP); Takashi Yamamoto, Tokyo (JP); Hideki Watanabe, Tokyo (JP); Nobuto Kashiwagi, Tokyo (JP); Junichi Murakami, Tokyo (JP)

(73) Assignee: Sega Corporation, Tokyo (JP)

( * ) Notice: Subject to any disclaimer, the term of this patent is extended or adjusted under 35 U.S.C. 154(b) by 426 days.

(21) Appl. No.: 10/570,698

(22) PCT Filed: Aug. 31, 2004

(86) PCT No.: PCT/JP2004/012565

§ 371 (c)(1),
(2), (4) Date: Mar. 3, 2006

(87) PCT Pub. No.: WO2005/025704

PCT Pub. Date: Mar. 24, 2005

(65) Prior Publication Data

US 2007/0029734 A1 Feb. 8, 2007

(30) Foreign Application Priority Data

Sep. 9, 2003 (JP) ..... 2003-317457

(51) Int. Cl.
*A63F 9/00* (2006.01)
*A63B 69/00* (2006.01)

(52) U.S. Cl. ..... 273/447; 273/448; 473/447

(58) Field of Classification Search ..... 273/447, 273/448

See application file for complete search history.

(56) References Cited

U.S. PATENT DOCUMENTS

| | | | | | |
|---|---|---|---|---|---|
| 5,711,530 | A * | 1/1998 | Lewis | 273/448 |
| 6,062,567 | A * | 5/2000 | Uetono et al. | 273/447 |
| 6,131,399 | A * | 10/2000 | Hall | 62/127 |
| 6,311,981 | B1 * | 11/2001 | Uetono et al. | 273/447 |
| 6,336,636 | B1 * | 1/2002 | Smart | 273/447 |
| 6,843,720 | B2 * | 1/2005 | Luciano et al. | 463/16 |
| 7,168,706 | B2 * | 1/2007 | Pierce et al. | 273/448 |

FOREIGN PATENT DOCUMENTS

| | | | |
|---|---|---|---|
| JP | 59-108967 | | 7/1984 |
| JP | 11-192375 | * | 7/1999 |
| JP | 2000-140405 | * | 5/2000 |

* cited by examiner

*Primary Examiner*—Peter DungBa Vo
*Assistant Examiner*—Masud Ahmed
(74) *Attorney, Agent, or Firm*—Ladas & Parry LLP

(57) ABSTRACT

A prize-capturing game apparatus 10 comprises a prize storage portion 14 in which a prize 18 is stored. A drop inlet 26 for dropping the prize 18 gripped by a movable body 24 is disposed on the prize storage portion 14. The drop inlet 26 is opened or closed by a shutter 74 of a mechanism 37 for opening and closing the drop inlet. A prize deposit room 30 is disposed below the drop inlet 26 and an outlet 32 for taking out the prize 18 is disposed on a front face of the prize deposit room 30. The outlet 32 is opened and closed by the prize outlet door 34. During a game, the shutter 74 opens the drop inlet 26 to receive the drop of the prize 18 and the prize outlet door 34 is locked in a closed position using a locking mechanism 62. After the game, the shutter 74 closes the drop inlet 26 and a lock of the prize outlet door 34 using the door locking mechanism 62 is released.

8 Claims, 20 Drawing Sheets

GIFT ACQUISITION GAME DEVICE

TECHNICAL FIELD

The present invention generally relates to a prize-capturing game apparatus, and particularly to a prize-capturing game apparatus in which a prize stored in the inside of a casing is obtained by dropping it to an outlet through an in accordance with an operation by a player.

BACKGROUND ART

Conventional prize-capturing game apparatuses include game apparatuses referred to as UFO catchers, for example. The prize-capturing game apparatus of this type, after a coin is inserted, moves a prize gripping mechanism disposed on a ceiling in the right and left directions and in the backward and forward directions in accordance with a button operation by a player. Then, the prize-capturing game apparatus lowers a clamp portion (formed into a UFO-like shape) having a pair of arms toward a given prize among a plurality of prizes placed in the inside of the casing surrounded with transparent glass, and grips the target prize.

By performing a clamp operation for opening and closing the pair of arms disposed on the clamp portion, the pair of arms grips the prize (a succeeded case) or the pair of arms fails to grip the prize (a failed case). Along with the closing movement of the pair of arms, the clamp portions is elevated and moved above a prize drop inlet. Then, the clamp portion drops the gripped prize into the prize drop inlet. Accordingly, the player is capable of taking out the prize from a prize outlet communicated with the prize drop inlet. The opening and closing movement of the pair of arms and the movement of the clamp portion are performed in the same manner in the case where the pair of arms disposed on the clamp portion grips the prize (the succeeded case) and in the case where the prize is dropped while it is transferred (the failed case).

In this manner, in the prize-capturing game apparatus, the series of movements by the prize gripping mechanism is performed as a single play. Conventionally, the upper limit on the size of prizes such as stuffed animals (stuffed bears, for example) is about 20 cm to 25 cm. However, in recent years, with the development of large-sized prizes, there is a request that large-sized prizes such as large stuffed animals having a size of about 35 cm to 40 cm, for example, be handled.

In order to promote the development of such large-sized prizes, it is necessary to enlarge the pair of arms for gripping prizes. Also, it is necessary to enlarge the opening area of the prize outlet in accordance with the prize size. In this case, countermeasures for preventing theft from the prize outlet pose a problem with respect to the large-sized prizes.

As mentioned above, when the opening area of the prize outlet is enlarged, for example, a small child may enter the prize outlet and illicitly obtain a prize placed in the inside of the casing from the prize outlet. And measures in terms of security are required.

In order to deal with such a security problem, a certain prize-capturing game apparatus has been proposed. The apparatus includes a first door rotatably disposed between the prize outlet and the prize drop inlet and configured to close the prize drop inlet from a lower side thereof, and a second door rotatably disposed on an outer wall of the casing and configured to open and close the prize outlet (refer to Patent Document 1: Japanese Laid-Open Patent Application No. 11-192375, for example).

In this structure, when the player opens the second door and inserts the hand from the prize outlet, the first door is opened in a vertical manner to block communication between the prize outlet and the prize drop inlet. When the first door is pressed and rotated in a lateral manner from the prize outlet, the prize drop inlet is closed from the lower side with the first door. Thus, the prize-capturing game apparatus disclosed in Patent Document 1 is capable of blocking intrusion from the outside with the first door when the player tries to take out the prize from the prize outlet, thereby preventing the theft of the prize.

However, conventional prize-capturing game apparatuses are problematic in that when an adult with long arms inserts the hand from the prize outlet, for example, it is possible to insert the hand from a clearance between a lower edge of the first door in a vertical state and the bottom of the prize outlet. Thus, it is possible to draw the prize positioned in the vicinity of the prize drop inlet to the prize outlet.

DISCLOSURE OF THE INVENTION

It is a general object of the present invention to provide an improved and useful prize-capturing game apparatus in which the above-mentioned problem is eliminated.

A more specific object of the present invention is to provide a prize-capturing game apparatus capable of preventing the theft of a prize.

In order to achieve the above-mentioned objects, the present invention provides the following measures.

According to one aspect, the present invention comprises: a drop inlet for allowing a player to drop a prize stored in the inside of a casing through an operation of the player; an outlet disposed on an outer wall of the casing, the outlet allowing the player to take out the prize dropped into the drop inlet; a drop inlet opening/closing portion disposed above the drop inlet or on a path from the drop inlet to the outlet, the drop inlet opening/closing portion opening and closing the drop inlet or the path; an opening/closing driving mechanism for opening and closing the drop inlet by driving the drop inlet opening/closing portion; an outlet opening/closing portion configured to be openable and closable when the player takes out the prize dropped into the drop inlet from the outlet; an outlet opening/closing detecting unit configured to detect opened and closed states of the outlet opening/closing portion; and a controlling unit configured to control opening and closing of the drop inlet and/or the outlet, in which the controlling unit controls driving of the drop inlet opening/closing portion such that the drop inlet is opened by the opening/closing driving mechanism if the outlet opening/closing portion has closed the outlet on the basis of a detection signal from the outlet opening/closing detecting unit.

Further, according to another aspect, the present invention includes: an outlet locking unit configured to maintain a state where the outlet is closed by locking the outlet opening/closing portion, in which the controlling unit maintains a state where the outlet opening/closing portion has closed the outlet by locking the outlet locking unit and controls driving of the drop inlet opening/closing portion such that the drop inlet is opened by the opening/closing driving mechanism if the outlet opening/closing portion has closed the outlet on the basis of a detection signal from the outlet opening/closing detecting unit.

Further, according to another aspect of the present invention, the controlling unit includes a notifying unit configured to notify the player to close the outlet if the outlet is opened on the basis of a detection signal from the outlet opening/closing detecting unit.

Further, according to another aspect, the present invention comprises: a drop inlet for allowing a player to drop a prize stored in the inside of a casing through an operation of the player; an outlet disposed on an outer wall of the casing, the outlet allowing the player to take out the prize dropped into the drop inlet; a drop inlet opening/closing portion disposed above the drop inlet or on a path from the drop inlet to the outlet, the drop inlet opening/closing portion opening and closing the drop inlet or the path; an opening/closing driving mechanism for opening and closing the drop inlet by driving the drop inlet opening/closing portion; a drop inlet opening/closing detecting unit configured to detect opened and closed states of the drop inlet; an outlet opening/closing portion configured to be openable and closable when the player takes out the prize dropped into the drop inlet from the outlet; an outlet locking unit configured to maintain a state where the outlet is closed by locking the outlet opening/closing portion; and a controlling unit configured to control opening and closing of the drop inlet and/or the outlet, in which the controlling unit drives the drop inlet opening/closing portion using the opening/closing driving mechanism and controls the outlet opening/closing portion such that it is openable and closable by releasing a lock of the outlet locking unit if the drop inlet opening/closing portion has closed the drop inlet on the basis of a detection signal from the drop inlet opening/closing detecting unit.

Further, according to another aspect, the present invention includes: a drop inlet locking unit configured to maintain a state where the drop inlet opening/closing portion has closed the drop inlet, in which the controlling unit drives the drop inlet opening/closing portion using the opening/closing driving mechanism and, if the drop inlet opening/closing portion has closed the drop inlet on the basis of a detection signal from the drop inlet opening/closing detecting unit, maintains the state where the drop inlet opening/closing portion has closed the drop inlet using the drop inlet locking unit and controls opening/closing of the outlet opening/closing portion such that the outlet is opened by releasing a lock of the outlet locking unit.

Further, according to another aspect, the present invention comprises: a drop inlet for allowing a player to drop a prize stored in the inside of a casing through an operation of the player; an outlet disposed on an outer wall of the casing, the outlet allowing the player to take out the prize dropped into the drop inlet; a drop inlet opening/closing portion disposed above the drop inlet or on a path from the drop inlet to the outlet, the drop inlet opening/closing portion opening and closing the drop inlet or the path; an opening/closing mechanism biased by a biasing unit such that the drop inlet opening/closing portion is rotated and returned to an original position after the drop inlet opening/closing portion is rotated by colliding with the prize dropped into the drop inlet; a drop inlet opening/closing detecting unit configured to detect opened and closed states of the drop inlet; an outlet opening/closing portion configured to be openable and closable when the player takes out the prize dropped into the drop inlet from the outlet; an outlet locking unit configured to maintain a state where the outlet is closed by locking the outlet opening/closing portion; and a controlling unit configured to control opening and closing of the outlet, in which the controlling unit controls the outlet opening/closing portion such that it is openable and closable by releasing a lock of the outlet locking unit if the drop inlet opening/closing portion has closed the drop inlet on the basis of a detection signal from the drop inlet opening/closing detecting unit.

Further, according to another aspect, the present invention includes: a lock release operation portion for releasing a lock of the outlet locking unit through an operation of the player when the state where the outlet opening/closing portion has closed the outlet is maintained using the outlet locking unit, in which the controlling unit drives the opening/closing driving mechanism such that the drop inlet opening/closing portion closes the drop inlet and then the lock of the outlet locking unit is released in response to an operation signal from the lock release operation portion.

Further, according to another aspect, the present invention comprises: a drop inlet for allowing a player to drop a prize stored in the inside of a casing through an operation of the player; an outlet disposed on an outer wall of the casing, the outlet allowing the player to take out the prize dropped into the drop inlet; a drop inlet opening/closing portion disposed above the drop inlet or on a path from the drop inlet to the outlet, the drop inlet opening/closing portion opening and closing the drop inlet or the path; an opening/closing driving mechanism for opening and closing the drop inlet by driving the drop inlet opening/closing portion; a prize depositing portion for temporarily depositing the prize dropped into the drop inlet, the prize depositing portion including an outlet for allowing the player to take out the deposited prize; an object detecting unit configured to detect whether or not an object exists in the inside of the prize depositing portion; an object takeout notifying unit configured to notify the player to take out an object in the inside of the prize depositing portion; and a controlling unit configured to control opening and closing of the drop inlet, in which the controlling unit notifies the player to take out a prize in the inside of the prize depositing portion through the prize takeout notifying unit if the prize is dropped in the inside of the prize depositing portion on the basis of a detection signal from the prize detecting unit.

Further, according to another aspect, the present invention comprises: a drop inlet for allowing a player to drop a prize stored in the inside of a casing through an operation of the player; an outlet disposed on an outer wall of the casing, the outlet allowing the player to take out the prize dropped into the drop inlet; a drop inlet opening/closing portion disposed above the drop inlet or on a path from the drop inlet to the outlet, the drop inlet opening/closing portion opening and closing the drop inlet or the path; an opening/closing driving mechanism for opening and closing the drop inlet by driving the drop inlet opening/closing portion; a prize depositing portion for temporarily depositing the prize dropped into the drop inlet, the prize depositing portion including an outlet for allowing the player to take out the deposited prize; a pressure detecting unit configured to detect pressure applied to the inside of the prize depositing portion; and a controlling unit configured to control opening and closing of the drop inlet, in which the controlling unit controls driving of the drop inlet opening/closing portion such that the drop inlet is opened by the opening/closing driving mechanism if no pressure is applied to the inside of the prize depositing portion on the basis of a detection signal from the pressure detecting unit.

According to the present invention, the driving of the drop inlet opening/closing portion is controlled such that the drop inlet is opened by the opening/closing driving mechanism if the outlet opening/closing portion has closed the outlet on the basis of a detection signal from the outlet opening/closing detecting unit. Thus, the drop inlet is opened during an operation of the player and it is possible to drop the prize into the drop inlet and keep the player from illicitly taking out the prize in the casing from the outlet, thereby preventing the theft of the prize.

Further, according to the present invention, a state where the outlet opening/closing portion has closed the outlet is maintained by locking the outlet locking unit if the outlet opening/closing portion has closed the outlet on the basis of a detection signal from the outlet opening/closing detecting unit. Thus, it is possible to prevent the opening of the outlet opening/closing portion during an operation of the player and keep the player from illicitly taking out the prize in the casing from the outlet, thereby preventing the theft of the prize while the drop inlet is opened.

Further, according to the present invention, the player is notified to close the outlet if the outlet is opened on the basis of a detection signal from the outlet opening/closing detecting unit. Thus, if the player tries to start a game while the outlet opening/closing portion is opened before the game start, it is possible to instruct the player to close the outlet opening/closing portion.

Further, according to the present invention, the drop inlet opening/closing portion, is driven by the opening/closing driving mechanism and the outlet opening/closing portion is controlled such that it is openable and closable by releasing a lock of the outlet locking unit if the drop inlet opening/closing portion has closed the drop inlet on the basis of a detection signal from the drop inlet opening/closing detecting unit. Thus, it is possible to keep the player from opening the drop inlet opening/closing portion when the outlet opening/closing portion is opened and also keep the player from illicitly taking out the prize in the casing from the outlet, thereby preventing the theft of the prize.

Further, according to the present invention, the drop inlet opening/closing portion is driven using the opening/closing driving mechanism. And, if the drop inlet opening/closing portion has closed the drop inlet on the basis of a detection signal from the drop inlet opening/closing detecting unit, the state where the drop inlet opening/closing portion has closed the drop inlet is maintained using the drop inlet locking unit and opening/closing of the outlet opening/closing portion is controlled such that the outlet is opened by releasing a lock of the outlet locking unit. Thus, it is possible to keep the player from illicitly taking out the prize in the casing from the outlet, thereby preventing the theft of the prize.

Further, according to the present invention, an opening/closing mechanism is included, in which the mechanism is biased by a biasing unit such that the drop inlet opening/closing portion is rotated and returned to an original position after the drop inlet opening/closing portion is rotated by colliding with the prize dropped into the drop inlet. Thus, when failure occurs in an electrical system, the drop inlet opening/closing portion is automatically returned after the prize is dropped, so that it is possible to keep the player from illicitly taking out the prize in the casing from the outlet, thereby preventing the theft of the prize.

Further, according to the present invention, a lock release operation portion is included, in which a lock of the outlet locking unit is released through an operation of the player when the state where the outlet opening/closing portion has closed the outlet is maintained using the outlet locking unit. And, the opening/closing driving mechanism is driven such that the drop inlet opening/closing portion closes the drop inlet and then the lock of the outlet locking unit is released in response to an operation signal from the lock release operation portion. Thus, for example, when coins for a plurality of games are inserted to continuously play the plurality of games, it is possible to temporarily suspend the play and take out the prize by operating the lock release operation portion upon obtaining the prize during the play.

Further, according to the present invention, the player is notified to take out the prize in the inside of the prize depositing portion through the prize takeout notifying unit if the prize is dropped in the inside of the prize depositing portion on the basis of a detection signal from the prize detecting unit. Thus, it is possible to instruct the player to remember to take out the prize.

Further, according to the present invention, driving of the drop inlet opening/closing portion is controlled such that the drop inlet is opened by the opening/closing driving mechanism if no pressure is applied to the inside of the prize depositing portion on the basis of a detection signal from the pressure detecting unit. Thus, for example, when a child enters the outlet, the pressure detecting unit detects his weight and the drop inlet opening/closing portion is driven to a position for closing the drop inlet. Accordingly, it is possible to prevent the child from illicitly taking out the prize in the inside of the casing from the outlet.

DETAILED DESCRIPTION OF THE PREFERRED EMBODIMENTS

In the following, embodiments of the present invention will be described with reference to the accompanying drawings.

Embodiment 1

Figure 1:
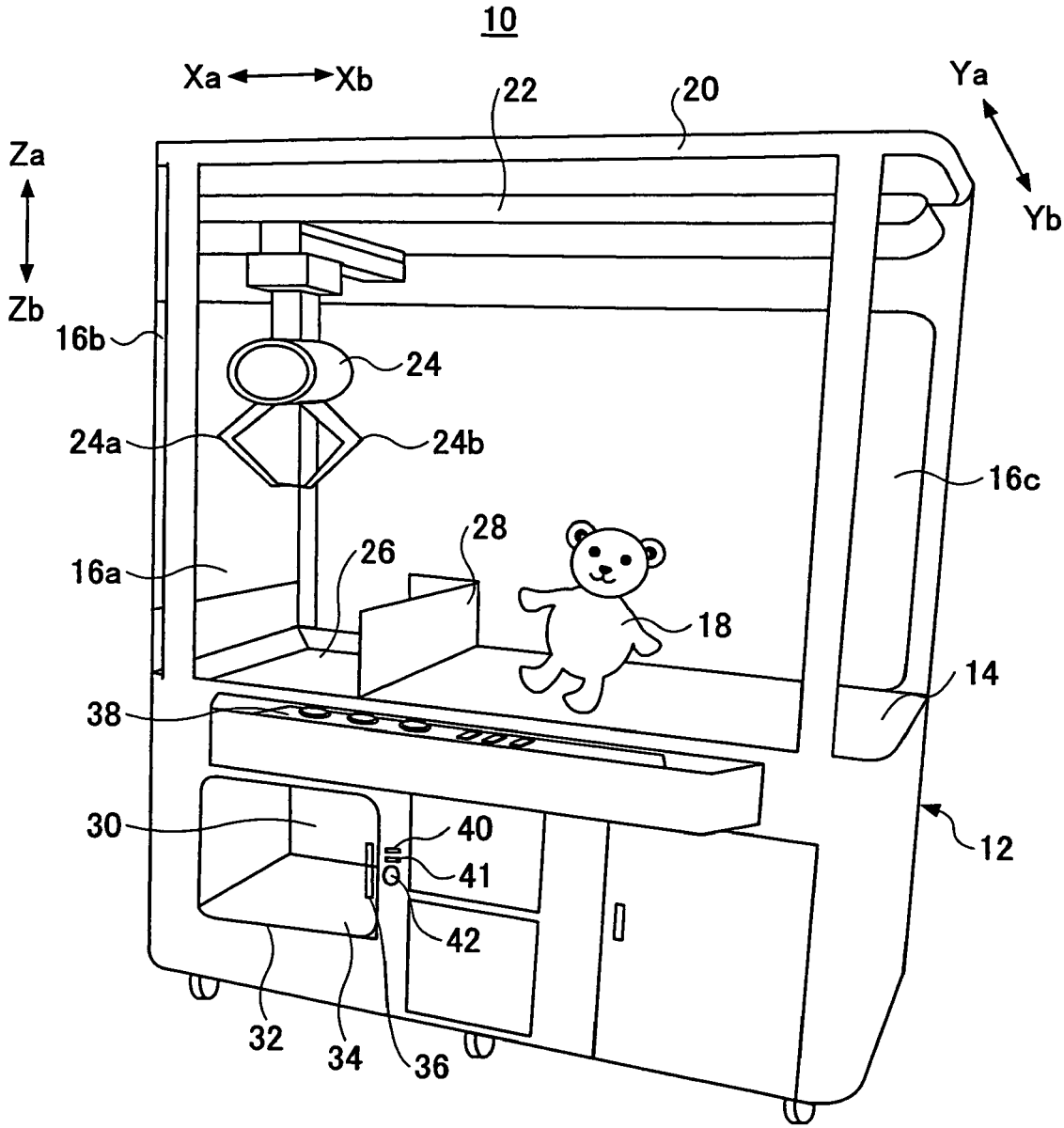
FIG. 1 is a configuration diagram showing an embodiment of a prize-capturing game apparatus according to the present invention.
Figure 2:
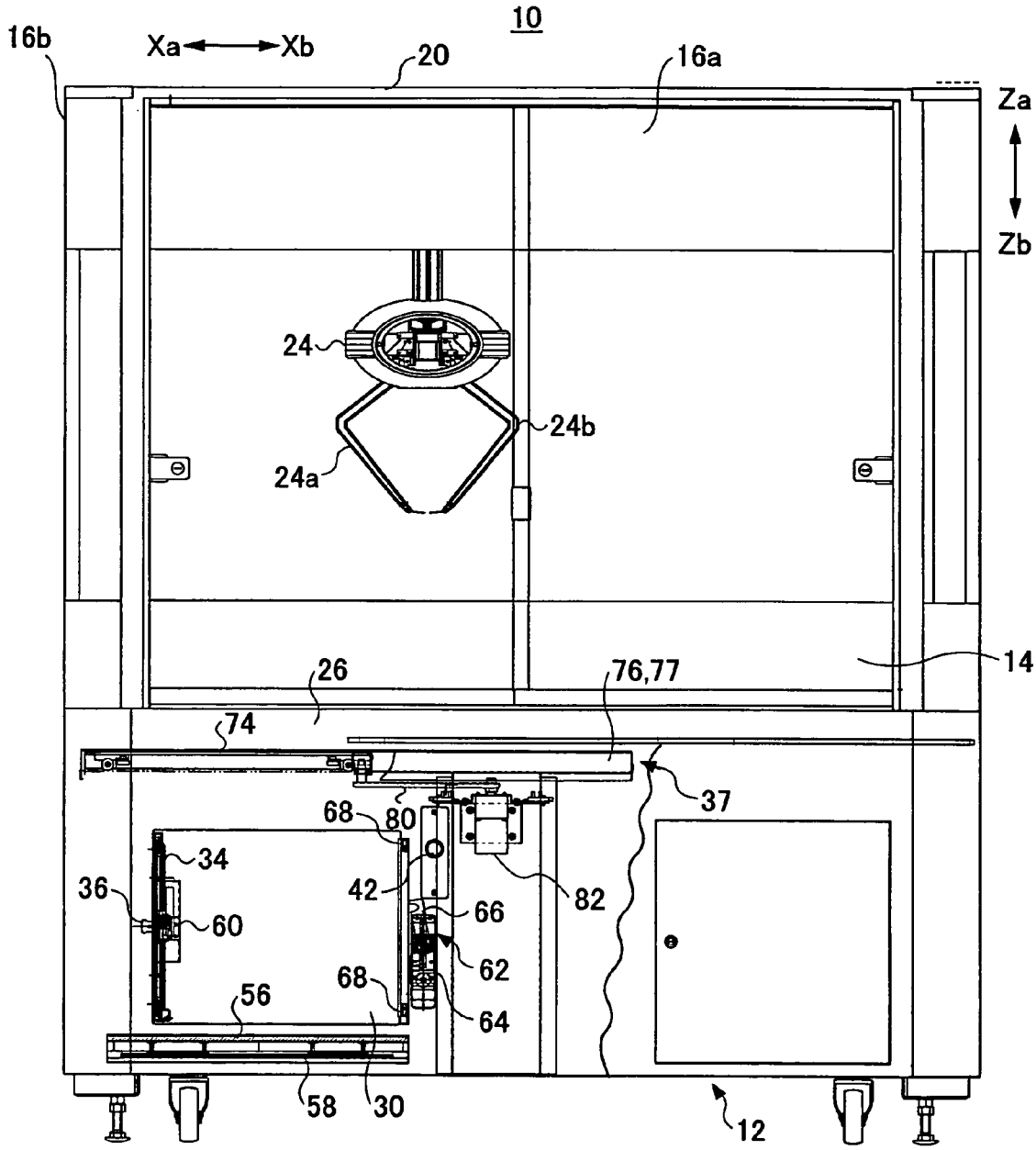
FIG. 2 is a front view with a partial cross-section showing each internal mechanism of a prize-capturing game apparatus.

FIG. 1 is a configuration diagram showing an embodiment of a prize-capturing game apparatus according to the present invention. FIG. 2 is a front view with a partial cross-section showing each internal mechanism of the prize-capturing game apparatus.

As shown in FIGS. 1 and 2, in a prize-capturing game apparatus 10, a prize storage portion 14 is disposed on the inside of a casing 12. Large-sized transparent windows 16*a* to 16*c* surrounding the prize storage portion 14 are disposed on a front face and right and left sides of the casing 12 and a back face board is disposed on a back face thereof. A plurality of prizes 18 are arranged in the prize storage portion 14. For example, relatively large stuffed animals are stored.

On a ceiling 20 supported by upper portions of the transparent windows 16*a* to 16*c*, a prize obtaining mechanism (a prize obtaining unit) 22 is disposed. Since the configuration of the prize obtaining mechanism 22 is known, description thereof is omitted.

The prize obtaining mechanism 22 has a suspended movable body 24 configured to move in the backward and forward directions (Ya and Yb directions), in the right and left directions (Xa and Xb directions), and in the upward and downward directions (Za and Zb directions). The movable body 24 before a game start is stationary in a standby position (a start position) shown in FIG. 1. Although the standby position (the start position) is set to a higher position relative to the drop inlet 26 for dropping a prize, the movable body 24 may be disposed in other position.

The drop inlet 26 is formed using an opening with an area sufficiently larger than the prize 18. In a boundary between the drop inlet 26 and the bottom of the prize storage portion 14, a partition board 28 including an acrylic board is erected. The partition board 28 involves a prize partitioning unit configured to partition the inside of the prize storage portion so as to keep the prize therein. In addition, the partition board 28 functions as a drop preventing unit configured to prevent stacked prizes from dropping into the drop inlet 26 through the shaking of the casing and the like (generated when a customer bumps against the casing, for example), for example. Also, the partition board 28 functions as a protection wall for preventing the theft of the prize 18, by which even when the player tries to insert the hand below the drop inlet 26, the partition board 28 prevents the player from reaching for the prize 18 stored in the prize storage portion 14. The partition board 28 is configured to be detachable, so that the attachment may be eliminated depending on stores.

The movable body 24 is designed to have an elliptical form to remind a UFO and a pair of arms (gripping members) 24*a* and 24*b* are disposed on a lower portion thereof. And a clamping mechanism (not shown in the drawings) for performing opening and closing operations of the pair of arms 24*a* and 24*b* is disposed on the inside of the movable body 24. The clamping mechanism opens the pair of arms 24*a* and 24*b* after the movable body 24 is moved in the backward and forward directions and in the right and left directions and stopped at a given position by the prize obtaining mechanism 22. Then, the clamp mechanism grips a given prize 18 by closing the pair of arms 24*a* and 24*b* after the movable body 24 is lowered. Thereafter, the movable body 24 is elevated.

Then, the movable body 24 is moved toward the standby position (the start position) by the prize obtaining mechanism 22 and stopped above the drop inlet 26. The clamp mechanism opens the pair of arms 24*a* and 24*b* again and drops the gripped prize 18 into the drop inlet 26.

A prize deposit room (a prize deposit portion) 30 is formed in a path from the drop inlet 26 to an outlet 32. The prize 18 dropped into the prize deposit room 30 can be taken out from the outlet 32 disposed on the front face of the casing 12. The outlet 32 and the prize deposit room 30 are provided with sufficiently large areas so as to support the development of the large-sized prize 18.

A prize outlet door (an opening/closing portion of the outlet) 34 including a transparent or translucent acrylic board is disposed on the outlet 32 in an openable and closable manner. A hinge (not shown in the drawings) is disposed on the prize outlet door 34 at a left end thereof when viewed from the front and a handle 36 is disposed on the prize outlet door 34 at a right end thereof. Thus, by rotating the prize outlet door 34 in the horizontal direction, the outlet 32 is opened and it is possible to take out the prize 18 dropped into the prize deposit room 30 from the drop inlet 26.

A mechanism 37 for opening and closing the drop inlet (an opening/closing driving mechanism) is disposed on the inside of the casing 12. The mechanism 37 for opening and closing the drop inlet is controlled in association with the opening and closing of the prize outlet door 34 as will be described in the following and opens the drop inlet 26 during a game only when the outlet 32 is closed with the prize outlet door 34. Only when the drop inlet 26 is closed by the mechanism 37 for opening and closing the drop inlet, the lock of the prize outlet door 34 is released and it is possible to take out the prize 18.

Further, an operation portion 38 for allowing the player to perform operation is disposed on the front face of the casing 12. Below the operation portion 38, there are disposed a door close indicating lamp 40, a door open indicating lamp 41, and a switch button (a lock release operation portion) 42 for releasing the door lock of the prize outlet door 34 operated when taking out the prize 18 obtained during a plurality of plays from the prize deposit room 30.

Figure 3:
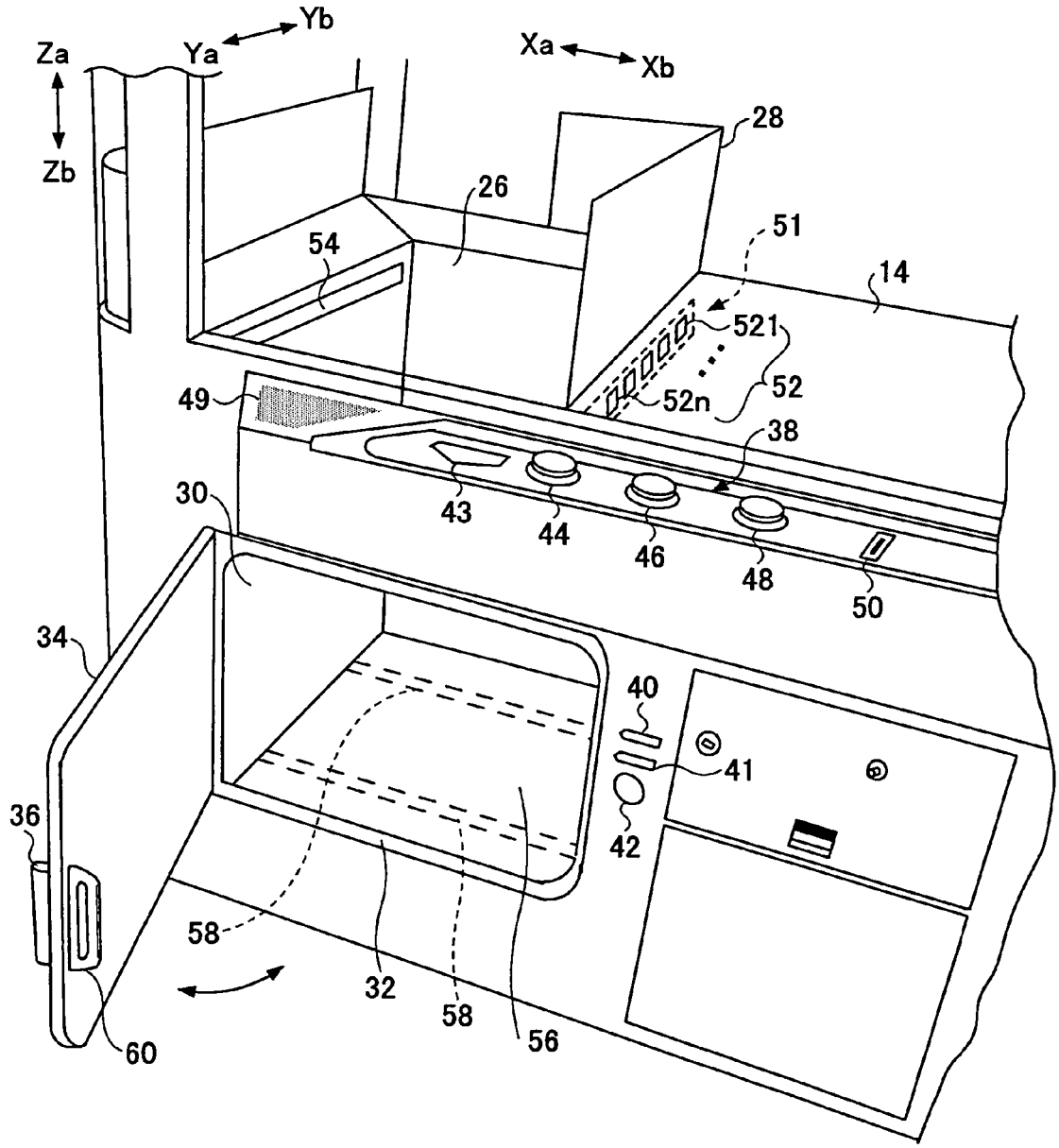
FIG. 3 is an enlarged perspective view showing an operation portion 38 and a prize deposit room 30 of a prize-capturing game apparatus 10.

FIG. 3 is an enlarged perspective view showing the operation portion 38 and the prize deposit room 30 of the prize-capturing game apparatus 10.

As shown in FIG. 3, when taking out the prize 18 dropped into the prize deposit room 30, the player is capable of opening the outlet 32 by pulling the handle 36 and rotating the prize outlet door 34 in the lateral direction. Because the prize outlet door 34 is biased in a closing direction with a biasing member 72 as will be described in the following, the prize outlet door 34 is configured to rotate in the closing direction to close the outlet 32 regardless of the existence of a closing operation by the player after the prize 18 is taken out.

The operation portion 38 is protruded from the front face of the casing 12. The operation portion 38 comprises an instruction portion 43 for instructing the player to close the prize outlet door 34 when the prize outlet door 34 is opened, a switch button 44 of operation in X direction for moving the movable body 24 in the horizontal direction, a switch button 46 of operation in Y direction for moving the movable body 24 in the backward and forward directions, an operation button 48 for performing a predetermined operation (moving/stopping the movable body in the upward and downward directions, for example) besides the operations of the switches 44 and 46, and a coin slot 50.

When the player wishes to play a plurality of games continuously, by inserting coins exceeding the fee for a single game into the coin slot 50, it is possible to deposit game fees for the following games as a credit. The number of remaining games is displayed to the player on a display portion (not shown in the drawings) and the plurality of games are set.

The prize deposit room 30 has the drop inlet 26 opened above and the outlet 32 opened on the front face. A prize drop detecting portion 51 for detecting the drop of the prize 18 is disposed on a surface of a side wall of the path from the drop inlet 26 to the outlet 32. The prize drop detecting portion 51 comprises an infrared sensor 52 (an object detecting unit shown with dashed lines in FIG. 3), and a reflecting plate 54 for reflecting a detecting light (infrared light) emitted from the infrared sensor 52. A plurality of infrared sensors 52 include a combination of a light-emitting element and a light-receiving element, for example, and output a detection signal when the infrared light from the light-emitting element cannot be received with the light-receiving element.

In the prize drop detecting portion 51, the plurality of infrared sensors 52 ($\mathbf{52}_1$ to $\mathbf{52}n$) are arranged in a line. The infrared light emitted from the light-emitting element of the plurality of infrared sensors 52 ($\mathbf{52}_1$ to $\mathbf{52}n$) is reflected with the reflecting plate 54 and the reflected light is received by the light-receiving element of the infrared sensor 52. The prize 18 blocks a plurality of infrared lights when passing through the drop inlet 26, whereby the plurality of infrared sensors 52 ($\mathbf{52}_1$ to $\mathbf{52}_n$) detect the prize 18 being dropped. According as the number of the plurality of infrared sensors 52 ($\mathbf{52}_1$ to $\mathbf{52}n$) disposed is increased, the resolution of detection is improved. In the present embodiment, not less than fourteen sensors are disposed.

In the prize drop detecting portion 51, the plurality of infrared sensors 52 ($\mathbf{52}_1$ to $\mathbf{52}_n$) are arranged on one side of the drop inlet 26 in a concentrated manner and the reflecting plate 54 is disposed on the opposite side. The light-emitting element and the light-receiving element may be separate bodies and disposed on both sides in an opposing manner. However, the side where the infrared sensor 52 is disposed is positioned closely to a game board (not shown in the drawings) disposed on the inside of the casing, so that the wiring work thereof is easier than the case where the sensors are disposed on both sides.

The infrared sensor 52 emits an infrared light at constant periods, allows the infrared light to be reflected with the reflecting plate 54, and receives the reflected light, thereby performing sensing. Thus, by successively emitting and receiving the light at predetermined periods using the plurality of infrared sensors 52 ($\mathbf{52}_1$ to $\mathbf{52}n$), it is possible to deal with the drop inlet 26, which is a detection area, as a plane. And when the emitted infrared light cannot be received, it is possible to detect the existence of an object. Thus, it is possible to detect the presence or absence of the dropped prize 18 and a child when he enters the prize deposit room 30 and blocks the infrared light.

A pressure sensor 58 for detecting weight (shown with dashed lines in FIG. 3) is disposed on a backside of a bottom plate 56 of the prize deposit room 30. The pressure sensor 58 may be of a type which outputs a detection signal in response to weight not less than five kg. For example, when the prize 18 of not more than five kg is dropped, the pressure sensor 58 does not output the detection signal, while when a child having not less than five kg enters the prize deposit room 30 from the outlet 32, for example, the pressure sensor 58 outputs the detection signal in response to the weight of the child. Although the present embodiment employs a pressure sensor formed into a thin strip referred to as a tape switch, the pressure sensor is not limited to this, and other pressure sensor (a load cell, for example) may be used.

When the pressure sensor 58 detects the application of weight for not less than a predetermined time set in advance, it is determined that an object exists in the prize deposit room 30 (the child or the like enters and does not come out, for example), and a buzzer 59 (refer to FIG. 9) emits a buzzer sound at high volume. Accordingly it is possible to prompt the child who entered the prize deposit room 30 to come out before he gets injured.

To an inner right end of the prize outlet door 34, a hook 60 for locking the door is attached. The hook 60 is locked in a door closed state using a door locking mechanism 62 (hidden and not shown in FIG. 3) as will be described below.

The door locking mechanism is described in the following.

Figure 4:
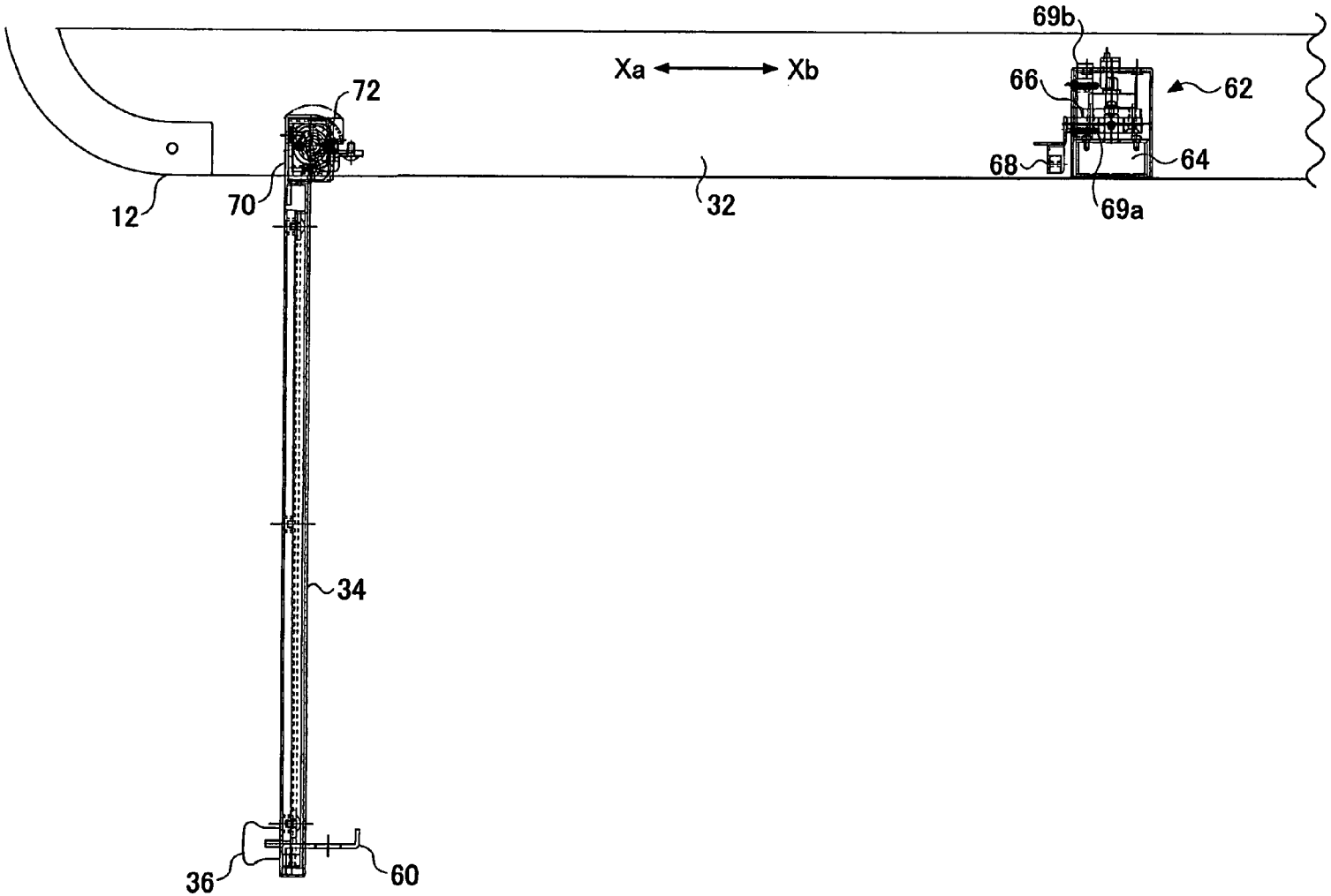
FIG. 4 is a plan view showing a prize outlet door 34 being opened.
Figure 5:
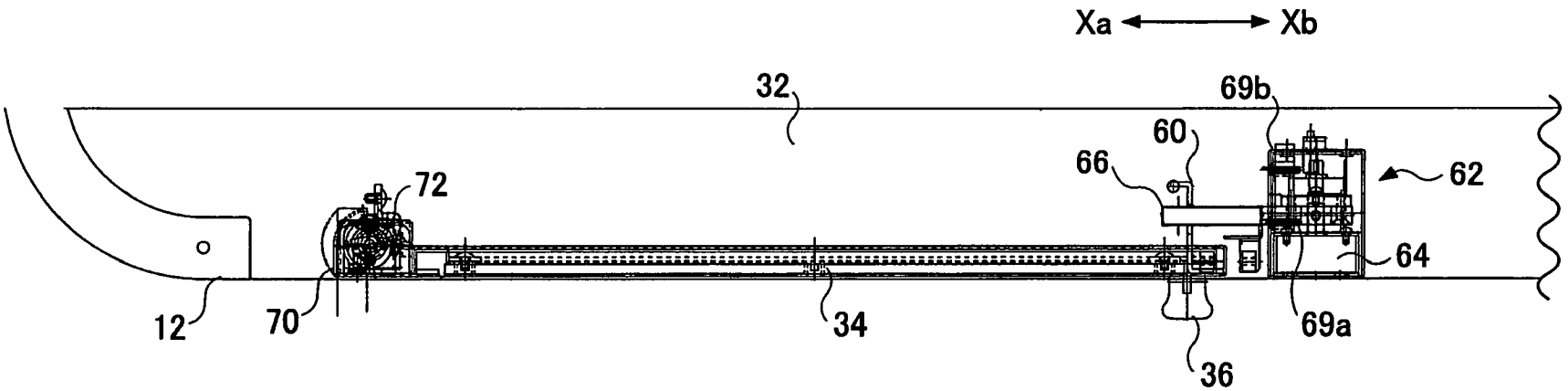
FIG. 5 is a plan view showing the prize outlet door 34 being closed.

FIG. 4 is a plan view showing the prize outlet door 34 being opened. FIG. 5 is a plan view showing the prize outlet door 34 being closed.

As shown in FIG. 4, the door locking mechanism (the outlet locking unit) 62 for locking the prize outlet door 34 in a closed state is disposed on the inside of the casing 12. The locking mechanism 62 comprises a locking motor 64, a plate-like engaging member 66 disposed on a rotary shaft of the locking motor 64, and a door sensor (a detecting unit configured to detect the opening/closing of the outlet) 68 for detecting whether the prize outlet door 34 is in a closed position or not.

The door locking mechanism 62 also includes a door lock detecting switch 69*a* (refer to FIG. 6) for detecting whether the engaging member 66 is engaged with the hook 60 and rotated to a door lock position for locking the prize outlet door 34, and a door lock release detecting switch 69*b* for detecting whether the engaging member 66 is spaced from the hook 60 and rotated to a door lock releasing position for releasing the lock of the prize outlet door 34.

The prize outlet door 34 is rotated fully opened at an angle of about 90 to 100 degrees relative to a hinge 70 as a fulcrum. In addition, the biasing member 72 for biasing the prize outlet door 34 in the closing direction is disposed on the hinge 70. Thus, after the player opened the prize outlet door 34 and took out the prize 18, when the player releases the prize outlet door 34, the prize outlet door 34 is automatically returned to the closed state (shown in FIG. 5) by the biasing member 72.

As shown in FIG. 5, in the locking mechanism 62, when a coin of a predetermined fee is inserted into the coin slot 50 with the outlet 32 closed using the prize outlet door 34, the locking motor 64 is driven and the engaging member 66 is rotated to engage with the hook 60. Accordingly, the hook 60 is locked by the engaging member 66 and the prize outlet door 34 cannot be opened. In other words, the locking mechanism 62 locks the prize outlet door 34 in the closed position.

This prevents the player from intruding into the prize deposit room 30 from the outlet 32 and also prevents the player from illicitly taking out the prize 18 placed in the prize storage portion 14. Thus, the door locking mechanism 62 is capable of preventing the player from inserting the hand from the outlet 32 and the theft of the prize 18 by locking the prize outlet door 34 and closing the outlet 32.

Further, when the door sensor 68 of the locking mechanism 62 cannot detect the state where the prize outlet door 34 is closed, the instruction portion 43 displays a message for instructing the player to close the prize outlet door 34, or an announcement such as "Please close the door" is made through a speaker 49.

When the prize outlet door 34 is closed and the door sensor 68 is ON, the locking motor 64 is driven and the engaging member 66 is rotated to engage with the hook 60, thereby locking the prize outlet door 34 in the closed position.

In the following, the configuration of the mechanism 37 for opening and closing the drop inlet mentioned above is described.

Figure 6:
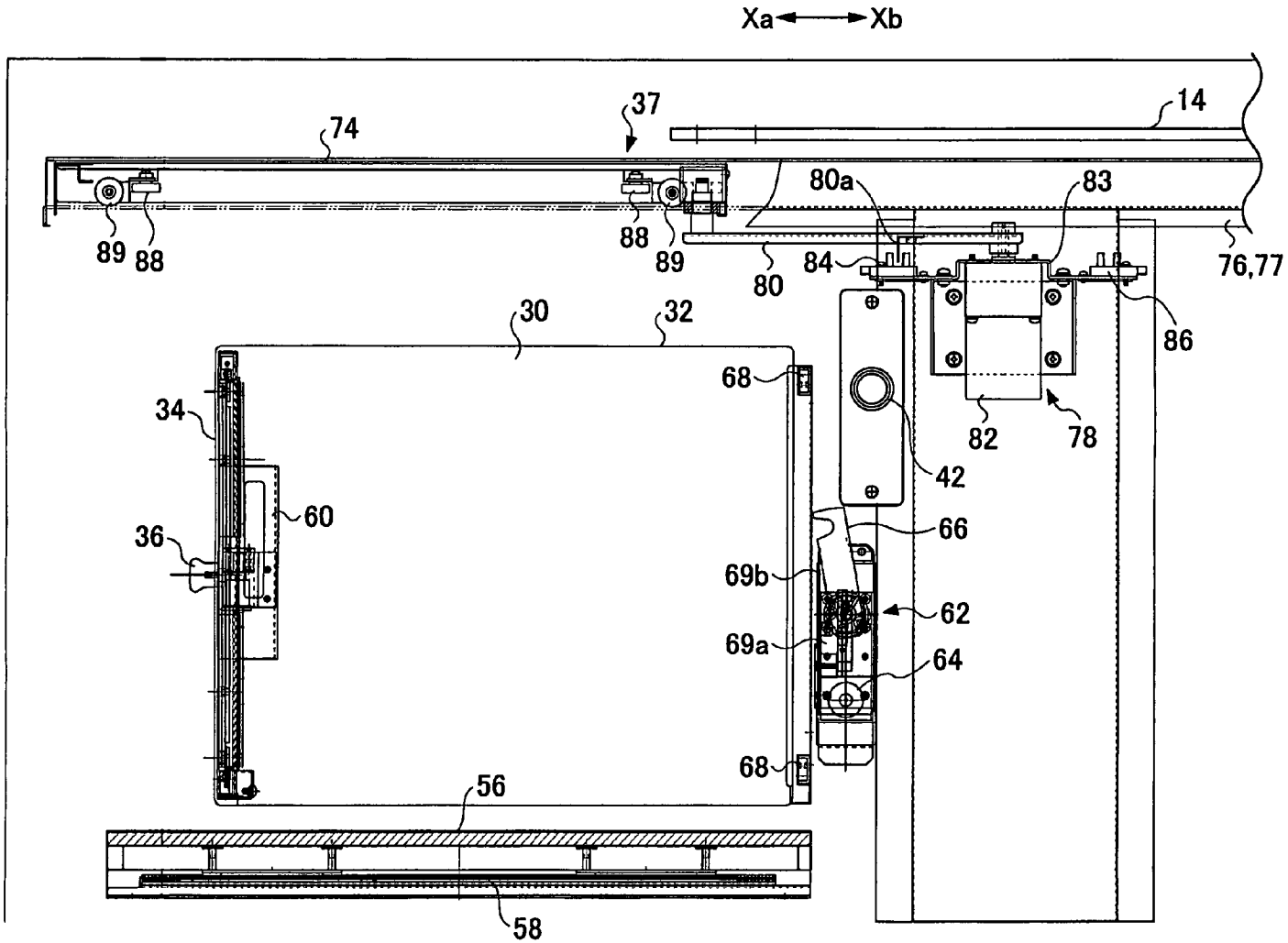
FIG. 6 is an enlarged front view showing a mechanism 37 for opening and closing the drop inlet.
Figure 7:
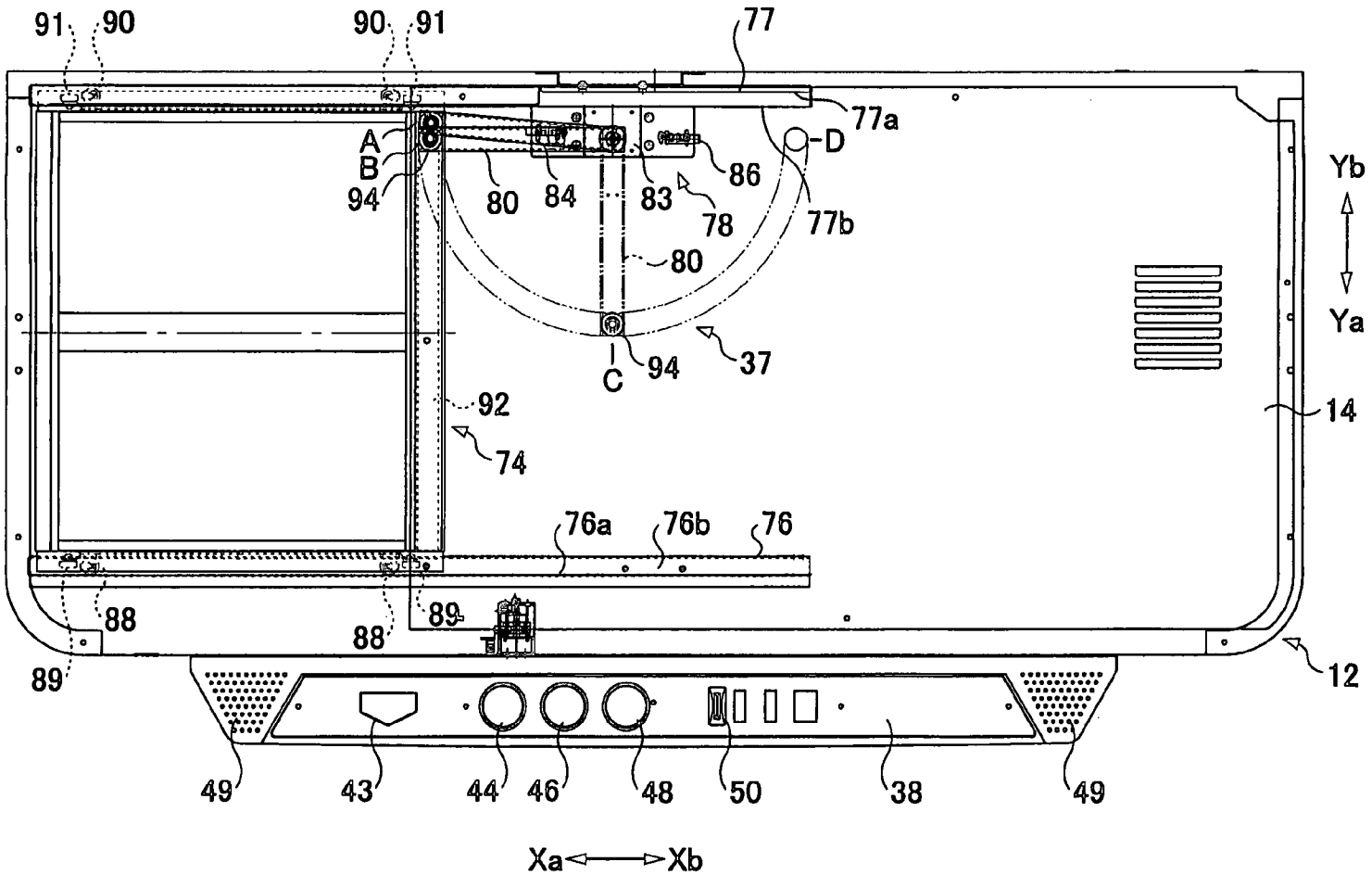
FIG. 7 is a plan view showing the mechanism 37 for opening and closing the drop inlet with a drop inlet 26 closed.
Figure 8:
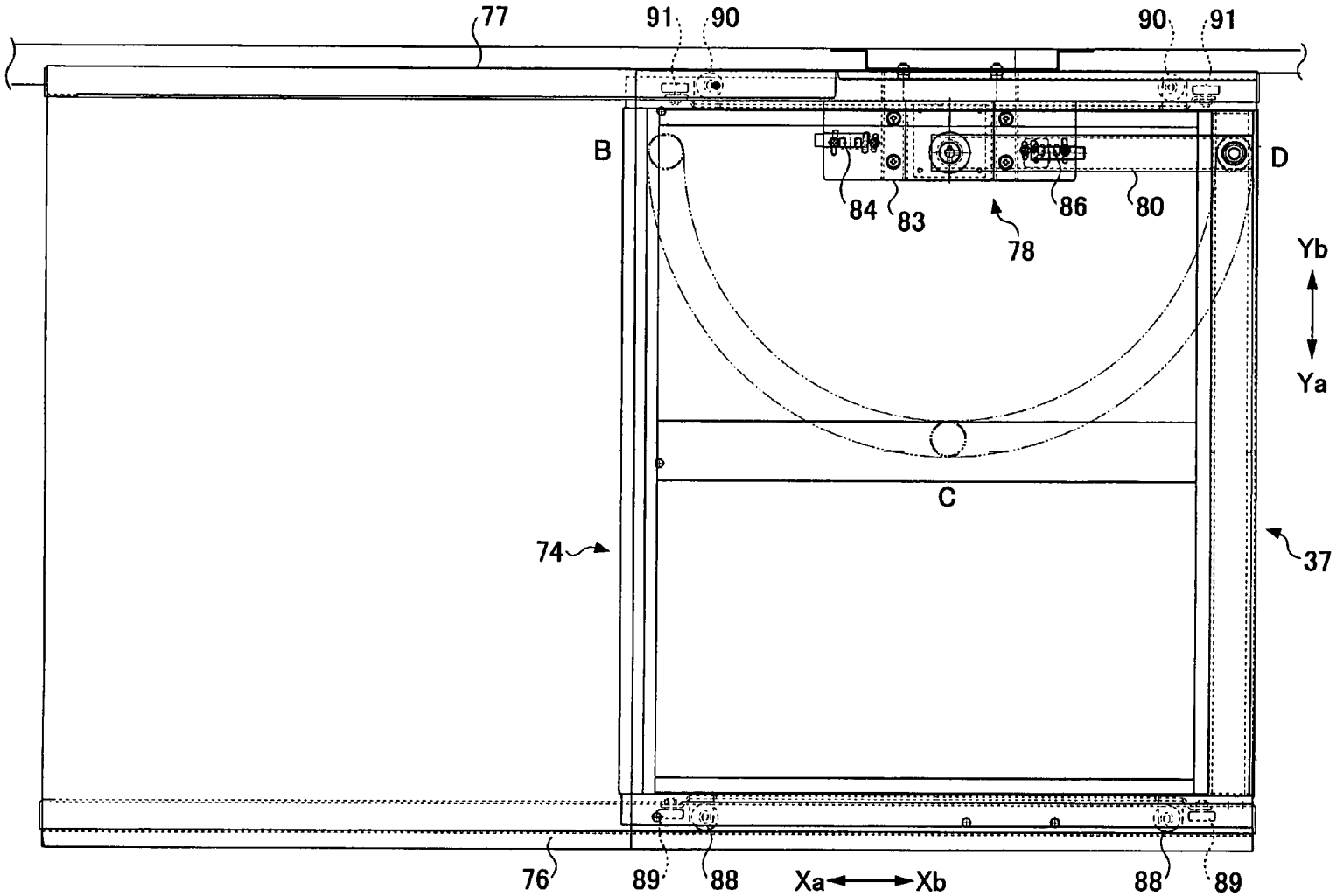
FIG. 8 is a plan view showing the mechanism 37 for opening and closing the drop inlet with the drop inlet 26 opened.

FIG. 6 is an enlarged front view showing the mechanism 37 for opening and closing the drop inlet. FIG. 7 is a plan view showing the mechanism 37 for opening and closing the drop inlet with the drop inlet 26 closed. And FIG. 8 is a plan view showing the mechanism 37 for opening and closing the drop inlet with the drop inlet 26 opened.

As shown in FIGS. 6 and 7, the mechanism 37 for opening and closing the drop inlet comprises a shutter (a portion for opening and closing the drop inlet) 74 including a slide plate for opening and closing the drop inlet 26, a pair of guide rails 76 and 77 for guiding both sides of the shutter 74, and a driving portion 78 for moving the shutter 74 in the Xa and Xb directions (the closing direction or the opening direction).

The driving portion 78 comprises a turning arm 80 for engaging with the shutter 74, a shutter driving motor 82 for turning the turning arm 80 in the horizontal direction, a closed position detecting switch (a unit configured to detect the closing of the drop inlet) 84 for detecting whether the turning arm 80 is rotated to the closed position, and an opened position detecting switch (a unit configured to detect the opening of the drop inlet) 86 for detecting whether the turning arm 80 is rotated to the opened position.

The shutter 74 is slidably disposed between the opened position for opening the drop inlet 26 during the game and the closed position for closing the drop inlet 26 after the game. Thus, the mechanism 37 for opening and closing the drop inlet closes the drop inlet 26 by sliding the shutter 74, and thus blocks communication between the prize deposit room 30 and the drop inlet 26, thereby preventing the theft of the prize 18 with the shutter 74 in the closed position when the player tries to insert the hand from the outlet 32 to steal the prize 18 disposed in the vicinity of the drop inlet 26.

On the side of the shutter 74 in the backward and forward directions, a plurality of rollers 88 to 91 for rolling on the guide rails 76 and 77 are disposed. The roller 88 is configured to abut on a horizontal portion 76*a* of the guide rail 76 and the roller 89 is configured to abut on a vertical portion 76*b* of the guide rail 76. Further, the roller 90 is configured to abut on a horizontal portion 77*a* of the guide rail 77 and the roller 91 is configured to abut on a vertical portion 77*b* of the guide rail 77.

Thus, the shutter 74 is guided in the Xa and Xb directions (the closed position direction or the opened position direction) by the rollers 88 to 91 while being regulated in the backward and forward directions and in the upward and downward directions. On an undersurface of the shutter 74, an engaging groove 92 formed in an elongated manner in the backward and forward directions is disposed. An engaging roller 94 disposed on the tip of the turning arm 80 is fitted in the engaging groove 92. Accordingly, a turning movement of the turning arm 80 is converted into a sliding movement (linear motion) of the shutter 74 by the engaging roller 94 moving along the engaging groove 92.

On an undersurface of the turning arm 80, a position detecting piece 80*a* is protruded and the position detecting piece 80*a* passes through a shutter closed position detecting switch 84 and a shutter opened position detecting switch 86 supported by a bracket 83 of the shutter driving motor 82. In the present embodiment, the shutter closed position detecting switch 84 and the shutter opened position detecting switch 86 include a U-shaped photo interrupter. When the position detecting piece 80*a* passes through a space between a light-emitting element and a light-receiving element, a detection light is blocked and a detection signal is outputted. Thus, the passage position of the position detecting piece 80*a* is detected upon passing through the shutter closed position detecting switch 84 and the shutter opened position detecting switch 86.

The amount of movement of the shutter 74 in the Xa and Xb directions is determined in accordance with the length of the turning arm 80. A rotation angle of the turning arm 80 is set to about 190 degrees. In other words, as shown in FIG. 7, rotation positions of the turning arm 80 include a lock position A for locking the shutter 74 in a locked state, a closed position B where the shutter 74 reaches the closed position, a middle position C where the shutter 74 is positioned in the middle of the sliding movement, and an opened position D where the shutter 74 reaches the opened position. In FIG. 7, the frame of the shutter 74 is shown and a plate to be fixed on the frame is omitted.

The shutter closed position detecting switch 84 detects whether the turning arm 80 is in the lock position A and the shutter opened position detecting switch 86 detects whether the turning arm 80 is in the opened position D. When the turning arm 80 is in the lock position A, a dead point of the turning radius relative to a reciprocating motion is passed, so that when the player tries to slide the shutter 74 in the Xb direction, the turning arm 80 is lodged and functions as a drop inlet locking unit. Thus, the shutter 74 is held in the closed position. Accordingly, when the power is off due to failure, for example, the shutter 74 is locked in the closed position due to the rotation angle of the turning arm 80, so that when the player tries to insert the hand into the prize deposit room 30 to open the shutter 74, the turning arm 80 is not rotated and the opening of the shutter 74 is prevented.

In the following, the operation of the mechanism 37 for opening and closing the drop inlet configured as mentioned above is described.

Before the player inserts a coin into the coin slot 50, in the mechanism 37 for opening and closing the drop inlet, as shown in FIG. 7, the shutter 74 is held in the lock position A. Then, when the player inserts a coin into the coin slot 50, the shutter driving motor 82 is driven to turn the turning arm 80 from the lock position A to the opened position D. Thus, the shutter 74 is slid in the Xb direction and moved to the opened position as shown in FIG. 8 in accordance with the rotation of the turning arm 80 in the counterclockwise direction.

By moving the shutter 74 to the opened position, the drop inlet 26 is fully opened. After the game is started, when the prize 18 is gripped using the arms 24*a* and 24*b* of the movable body 24 and dropped into the drop inlet 26, the shutter driving motor 82 is driven to turn the turning arm 80 from the opened position D to the lock position A. Thus, the shutter 74 is slid in the Xa direction and moved to the closed position in accordance with the rotation of the turning arm 80 in the clockwise direction.

Accordingly, when the player opens the prize outlet door 34 and takes out the prize 18 dropped into the prize deposit room 30, the drop inlet 26 is closed with the shutter 74 and the turning arm 80 holds the shutter 74 so as not to slide in the lock position A, so that the player cannot insert the hand into the prize storage portion 14 from the drop inlet 26 to illicitly obtain other prize.

Figure 9:
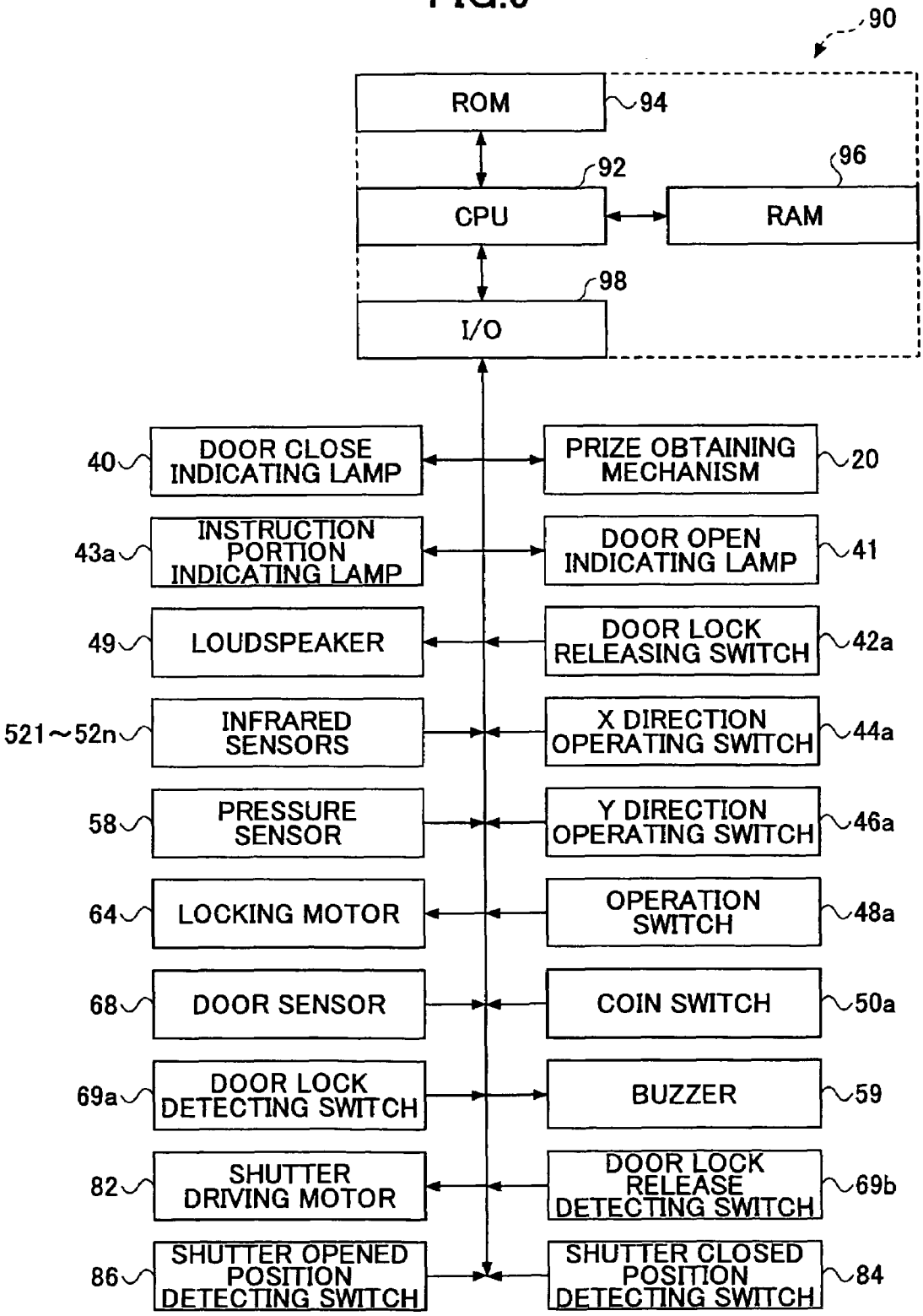
FIG. 9 is a block diagram showing a configuration of a control apparatus and each device.

FIG. 9 is a block diagram showing a configuration of a control apparatus and each device.

As shown in FIG. 9, a control apparatus 90 of the prize-capturing game apparatus 10 comprises a CPU (central processing unit), a ROM 94, a RAM 96, and an I/O interface 98. Each device mentioned above is connected to the I/O interface 98.

Examples of devices connected to the CPU 92 via the I/O interface 98 include each motor of the prize obtaining mechanism 22, the door close indicating lamp 40, the door open indicating lamp 41, a door lock releasing switch 42*a*, an instruction portion indicating lamp 43*a*, an X direction operating switch 44*a*, a Y direction operating switch 46*a*, other operation switch 48*a*, the loudspeaker 49, a coin switch 50*a* of the coin slot 50, the infrared sensors 52 ($\mathbf{52}_1$ to $\mathbf{52}_n$), the pressure sensor 58, the buzzer 59, the locking motor 64, the door sensor 68, the door lock detecting switch 69*a*, the door lock release detecting switch 69*b*, the shutter driving motor 82, the shutter closed position detecting switch 84, the shutter opened position detecting switch 86, and the like.

The ROM 94 stores a control program P1 for performing the drive control of the shutter 74 such that the drop inlet 26 is opened by the mechanism 37 for opening and closing the drop inlet when the prize outlet door 34 has closed the outlet 32 on the basis of a detection signal from the door sensor 68. The ROM 94 also stores a control program P2 for maintaining a state where the prize outlet door 34 has closed the outlet 32 by locking the door locking mechanism 62 when the prize outlet door 34 has closed the outlet 32 on the basis of the detection signal from the door sensor 68. The ROM 94 also stores a control program P3 for notifying the player to close the outlet 32 when the outlet 32 is opened on the basis of the detection signal from the door sensor 68.

Further, the ROM 94 stores a control program P4 for driving the shutter 74 using the mechanism 37 for opening and closing the drop inlet, and for controlling the prize outlet door 34 in an openable and closable manner by releasing the lock of the door locking mechanism 62 when the shutter 74 has closed the drop inlet 26 on the basis of the detection signal of the shutter closed position detecting switch 84. The ROM 94 also stores a control program P5 for driving the shutter 74 using the mechanism 37 for opening and closing the drop inlet, for maintaining the state where the prize outlet door 34 has closed the outlet 32 using the door locking mechanism 62 when the shutter 74 has closed the drop inlet 26 on the basis of the detection signal from the shutter closed position detecting switch 84, and for controlling the opening and closing of the prize outlet door 34 such that the outlet 32 is opened by releasing the lock of the door locking mechanism 62 in accordance with a signal from the door lock releasing switch 42*a*.

In the following, the control process performed by the CPU 92 of the control apparatus 90 mentioned above is described.

Figure 10:
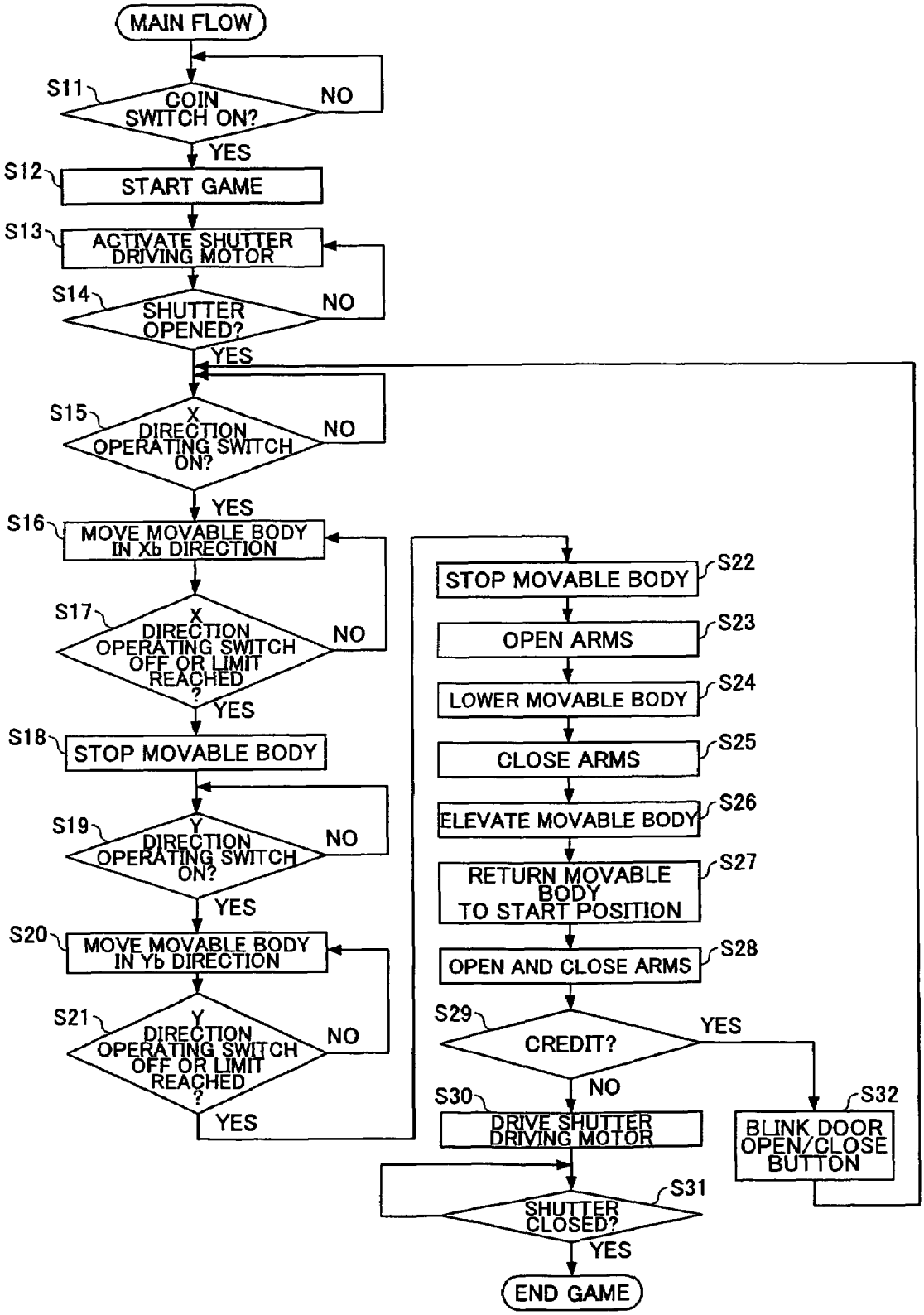
FIG. 10 is a flowchart for illustrating a main control process performed by a CPU 92.
Figure 11:
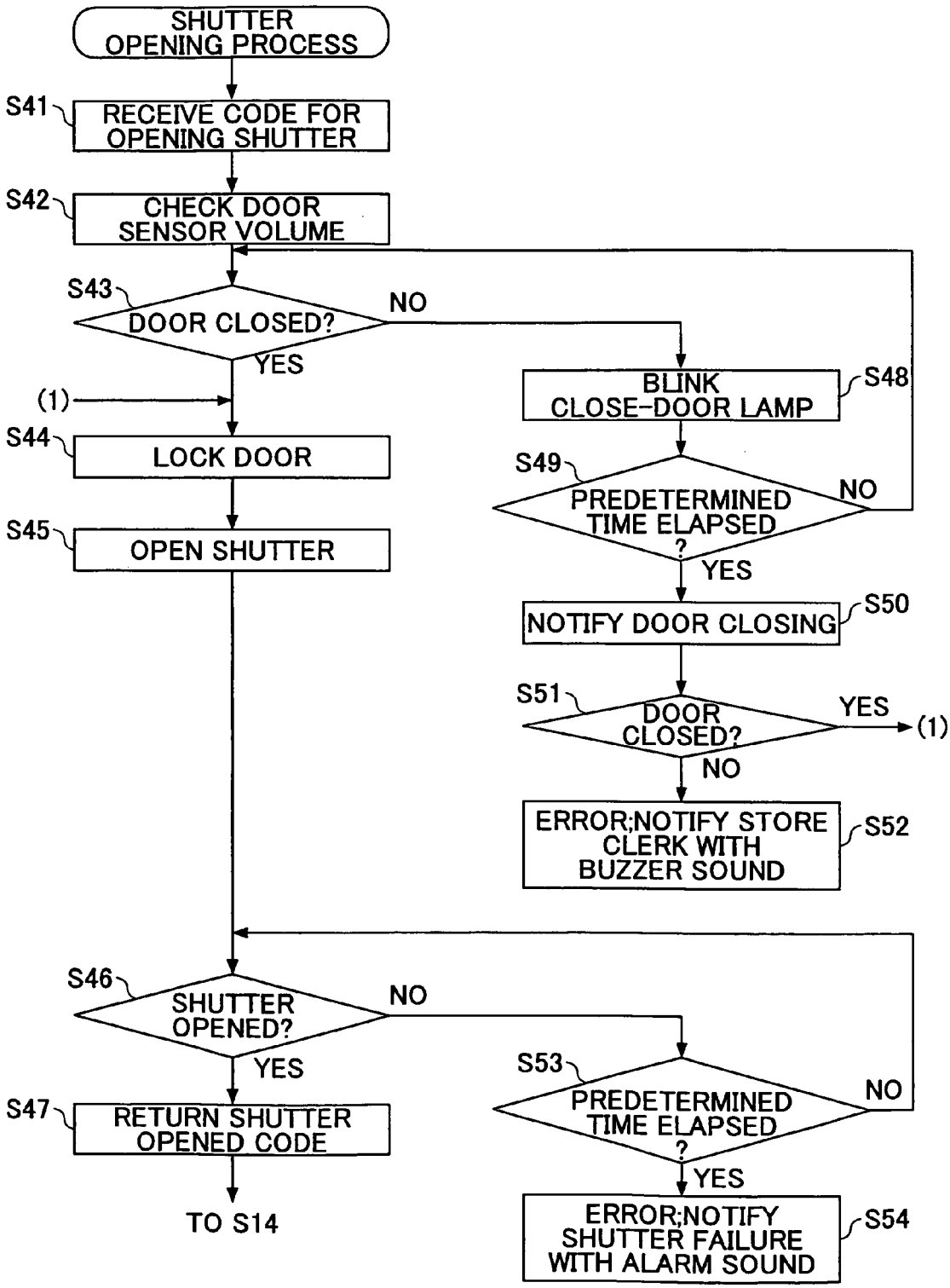
FIG. 11 is a flowchart for illustrating a process for controlling shutter opening performed by the CPU 92.
Figure 12:
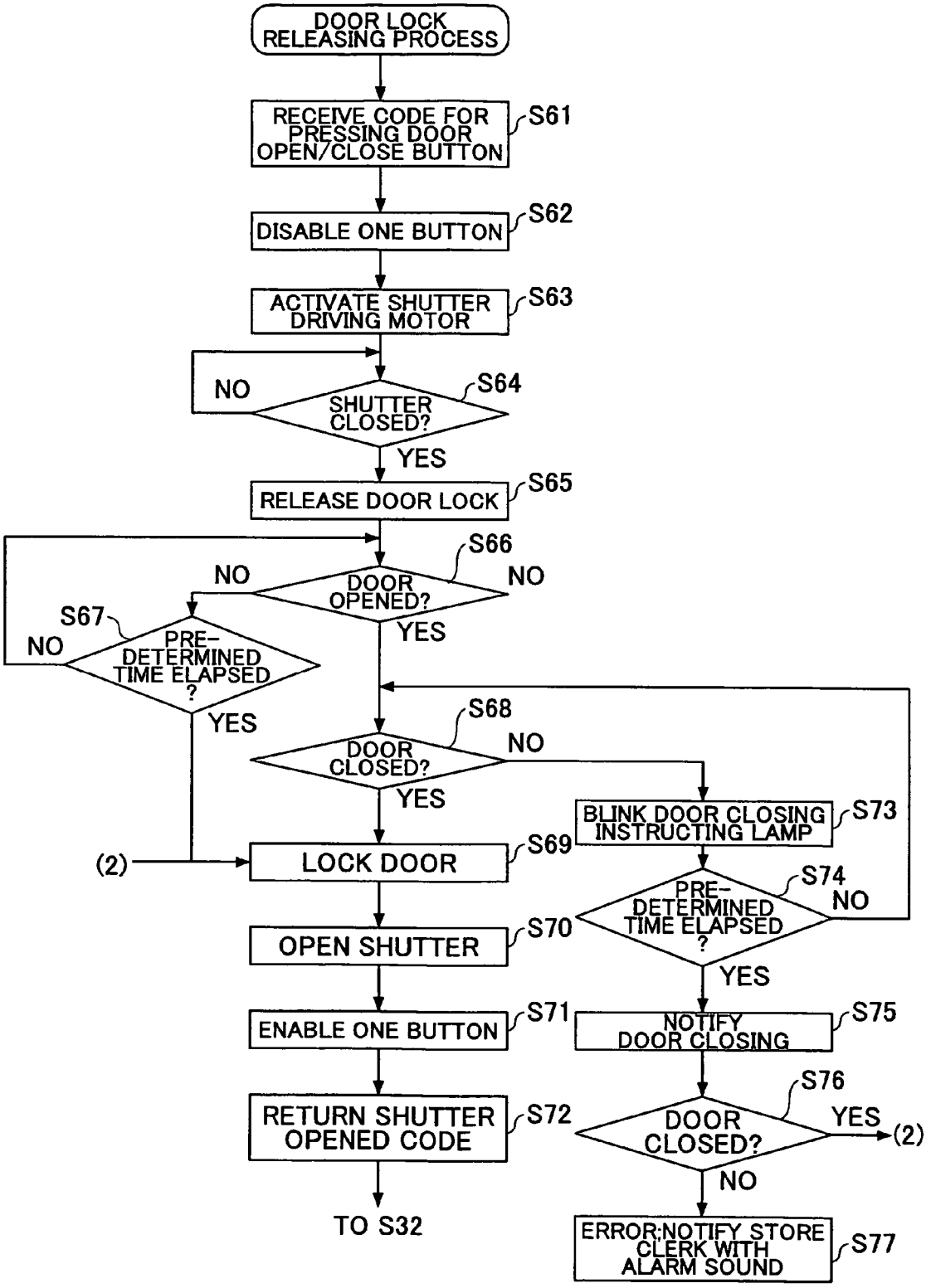
FIG. 12 is a flowchart for illustrating a process for controlling door opening and closing performed by the CPU 92.
Figure 13:
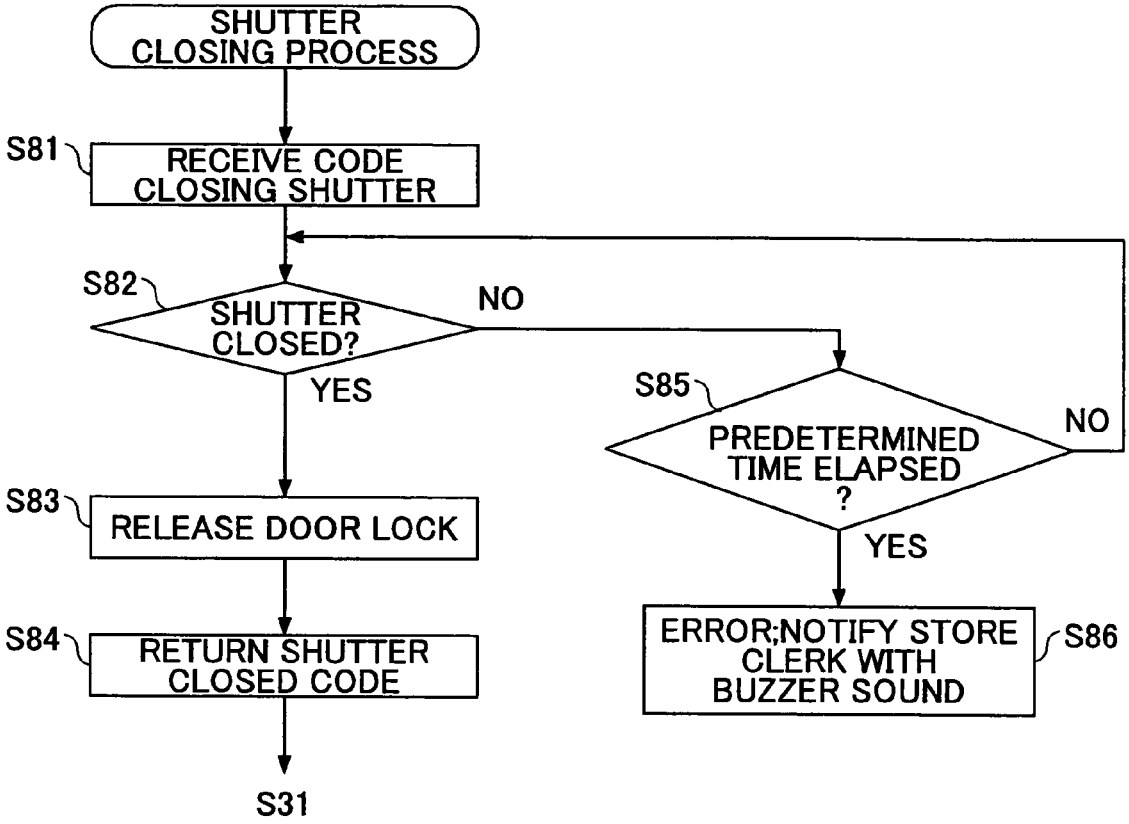
FIG. 13 is a flowchart for illustrating a process for controlling shutter closing performed by the CPU 92.

FIG. 10 is a flowchart for illustrating a main control process performed by the CPU 92. FIG. 11 is a flowchart for illustrating a process for controlling shutter opening performed by the CPU 92. FIG. 12 is a flowchart for illustrating a process for controlling door opening and closing performed by the CPU 92. And FIG. 13 is a flowchart for illustrating a process for controlling shutter closing performed by the CPU 92.

In the CPU 92 of the control apparatus 90, in S11 of FIG. 10, the coin switch 50*a* is switched to ON when the player inserts a coin of a predetermined amount of money into the coin slot 50. Then, the process proceeds to S12, where a game is started and an electronic music, for example, is played through the loudspeaker 49.

In the following S13, the shutter 74 is moved in the opening direction (the Xb direction) by driving the shutter driving motor 82 and the drop inlet 26 is opened. In S14, whether the shutter 74 is opened is confirmed. In other words, the process confirms whether the shutter opened position detecting switch 86 has detected the turning arm 80.

In the following S15, whether the X direction operating switch 44*a* is operated to ON is confirmed. When the player depresses the switch button 44 of operation in X direction, the X direction operating switch 44*a* is ON, so that the process proceeds to S16 and moves the movable body 24 in the Xb direction (the right direction when viewed from the front) by driving the prize obtaining mechanism 22. Next, the process proceeds to S17 and confirms whether the player has released the switch button 44 of operation in X direction and the switch button 44 of operation in X direction is OFF or whether a limit position in the X direction is reached.

In S17, if the X direction operating switch 44*a* is ON, the process returns to S16 and moves the movable body 24 in the Xb direction. And in S17, if the X direction operating switch 44*a* is OFF, or the movable body 24 has reached the limit position in the X direction, the process proceeds to S18 and stops the movable body 24. In the following S19, whether the Y direction operating switch 46*a* is operated to ON is confirmed.

When the player depressed the switch button 46 of operation in Y direction, the Y direction operating switch 46*a* is ON, so that the process proceeds to S20 and moves the movable body 24 in the Yb direction (the backward direction when viewed from the front) by driving the prize obtaining mechanism 22. Next, the process proceeds to S21 and confirms whether the player has released the switch button 46 of operation in Y direction and the Y direction operating switch 46*a* is OFF, or whether a limit position in the Y direction is reached.

In S21, if the Y direction operating switch 46*a* is ON, the process returns to S20 and moves the movable body 24 in the Yb direction. And in S21, if the Y direction operating switch 46*a* is OFF, or the movable body 24 has reached the limit position in the Y direction, the process proceeds to S22 and stops the movable body 24.

When the movement of the movable body 24 by the prize obtaining mechanism 22 is ended, the process proceeds to S23 and opens the pair of arms 24*a* and 24*b* disposed on the movable body 24. Then, the process proceeds to S24 and lowers the movable body 24 (in the Zb direction). In the following S25, a given prize 18 placed in the prize storage portion 14 is gripped by closing the pair of arms 24*a* and 24*b*.

Next, in S26, the gripped prize 18 is suspended by elevating the movable body 24 using the prize obtaining mechanism 22. In S27, the movable body 24 is returned to the standby position (the start position) by the prize obtaining mechanism 22. Thereafter, when the movable body 24 has reached the standby position (the start position) and become stationary, the pair of arms 24*a* and 24*b* are opened. Accordingly, the prize 18 gripped by the pair of arms 24*a* and 24*b* is dropped into the drop inlet 26. If the prize 18 is not gripped, although the pair of arms 24*a* and 24*b* are opened, the prize 18 is not dropped into the drop inlet 26.

In the following S29, if a plurality of games are set, whether there is an unused remaining credit is confirmed. In S29, if there is no remaining credit, the process proceeds to S30, moves the shutter 74 in the closing direction (the Xa direction) by driving shutter driving motor 82, and closes the drop inlet 26. In S31, whether the shutter 74 is closed or not is confirmed. In other words, the process confirms whether the shutter closed position detecting switch 84 has detected the turning arm 80 turned to the closed position A, thereby ending this game.

In S29, if there is an unused remaining credit, the process proceeds to S32 and blinks the door lock releasing switch button 42. Then the process returns to the aforementioned S15 and performs processing from S15 again.

In the following, the process for opening the shutter 74 in S13 is described in detail with reference to FIG. 11.

As shown in FIG. 11, when a code for instructing the opening of the shutter is received in S41, the process proceeds to S42 and checks the presence or absence of an output (volume) from the door sensor 68.

In the following S43, if a detection signal is outputted from the door sensor 68 as a result of the aforementioned S42, the process proceeds to S44. If the detection signal is not outputted from the door sensor 68, the process proceeds to S48. In S44, the engaging member 66 is locked on the hook 60 by driving the locking motor 64 of the locking mechanism 62. Accordingly, the prize outlet door 34 is locked in the closed state by the locking mechanism 62.

In the following S45, the shutter 74 is moved in the opening direction (the Xb direction) by driving the shutter driving motor 82. Next, the process proceeds to S46 and confirms whether the shutter 74 is opened. In other words, the process confirms whether the shutter opened position detecting switch 86 has detected the turning arm 80.

When the shutter opened position detecting switch 86 is ON in S46, the process proceeds to S47 and returns a code for notifying that the shutter 74 is moved to the opened position.

In S43, if the detection signal is not outputted from the door sensor 68, since the prize outlet door 34 has not closed the outlet 32, the process proceeds to S48 and instructs the player to close the prize outlet door 34 by blinking the indicating lamp 43*a* of the instruction portion 43.

In the following S49, whether a predetermined time set in advance has elapsed is confirmed and the aforementioned processing in S43 and S48 is repeated until the predetermined time has elapsed. If the prize outlet door 34 is not closed after the predetermined time has elapsed in S49, the process proceeds to S50 and an announcement such as "Please close the prize outlet door" is made through the speaker 49.

In the following S51, the presence or absence of the output from the door sensor 68 is checked again. In S51, if the detection signal is outputted from the door sensor 68, since the prize outlet door 34 is closed, the process returns to the aforementioned S44 and the processing from S44 is performed. In S51, if the detection signal is not outputted from the door sensor 68, since the prize outlet door 34 is not closed, the process proceeds to S52, an error is issued, and a buzzer sound is emitted to notify a store clerk that the prize outlet door 34 is not closed.

In S46, if the shutter opened position detecting switch 86 is not ON and whether the shutter 74 is moved to the opened position is not confirmed, the process proceeds to S53, in which whether a predetermined time has elapsed is confirmed and the aforementioned processing in S46 and S53 is repeated until the predetermined time has elapsed. In S53, if the shutter 74 has not moved to the opened position after the predetermined time has elapsed, the process proceeds to S54, an error is issued, and an alarm sound is emitted from the loudspeaker 49 to notify the store clerk of the failure of the shutter.

The following describes, with reference to FIG. 12, processing performed when the door lock releasing switch 42*a* is operated to ON in S32, in other words, door lock releasing processing when the player opens the prize outlet door 34 and takes out the prize 18 dropped into the prize deposit room 30 while the player has not finished all games in a case where a plurality of games are set and the prize 18 is dropped from the drop inlet 26 into the prize deposit room 30.

As shown in FIG. 12, when the door lock releasing switch 42*a* is operated to ON, a code for indicating that the door lock releasing switch 42*a* is ON is received in S61 and the process proceeds to S62 and sets the button operation of one play (operations of the switch button 44 of operation in X direction and the switch button 46 of operation in Y direction) to be disabled.

In the following S63, the shutter 74 is moved in the closing direction (the Xa direction) by driving the shutter driving motor 82 and the drop inlet 26 is closed. In S64, whether the shutter 74 is closed is confirmed. In other words, the process confirms whether the shutter closed position detecting switch 84 has detected the turning arm 80 turned to the closed position A.

In S64, when the shutter closed position detecting switch 84 is ON, the process proceeds to S65, in which the engaging member 66 is spaced from the hook 60 by driving the locking motor 64 of the locking mechanism 62, and the lock of the prize outlet door 34 is released. In the following S66, the presence or absence of the output from the door sensor 68 is checked.

In the following S66, if the detection signal is outputted from the door sensor 68, since the prize outlet door 34 is closed, the process proceeds to S47 and confirms whether the predetermined time has elapsed. If the predetermined time has not elapsed in S47, the process returns to S66 mentioned above.

In S66, if the detection signal is not outputted from the door sensor 68, since the prize outlet door 34 is opened and the prize 18 is taken out from the outlet 32, the process proceeds to S68 and checks the presence or absence of the output from the door sensor 68 again. In S68, if the detection signal is outputted from the door sensor 68, since the prize outlet door 34 is closed after the prize 18 is taken out, the process proceeds to S69. In S67, if the predetermined time has elapsed, the process proceeds to S69 since the prize 18 is not taken out in the predetermined time.

In S69, the engaging member 66 is engaged with the hook 60 and the prize outlet door 34 is locked in the closed state by driving the locking motor 64 of the locking mechanism 62. In the following S70, the shutter 74 is moved in the opening direction (the Xb direction) by driving the shutter driving motor 82 and the drop inlet 26 is opened.

Then the process proceeds to S71 and sets the button operation of one play (operations of the switch button 44 of operation in X direction and the switch button 46 of operation in Y direction) set to be disabled in S69 to be enabled. Next, in S72, a code for indicating that the shutter 74 is moved to the opened position is returned.

In S68 mentioned above, if the detection signal is not outputted from the door sensor 68, since the prize outlet door 34 is opened, the process proceeds to S73 and instructs the player to close the prize outlet door 34 by blinking the indicating lamp 43*a* of the instruction portion 43.

In the following S74, whether a predetermined time set in advance has elapsed is confirmed and the aforementioned processing in S68 and S73 is repeated until the predetermined time has elapsed. If the prize outlet door 34 is not closed after the predetermined time has elapsed in S74, the process proceeds to S75 and an announcement such as "Please close the prize outlet door" is made through the speaker 49, for example.

In the following S76, the presence or absence of the output from the door sensor 68 is checked again. In S76, if the detection signal is outputted from the door sensor 68, since the prize outlet door 34 is closed, the process returns to the aforementioned S69 and the processing from S69 is performed. In S76, if the detection signal is not outputted from the door sensor 68, since the prize outlet door 34 is not closed, the process proceeds to S77, an error is issued, and a buzzer sound is emitted to notify the store clerk that the prize outlet door 34 is not closed.

In the following, the shutter closing processing performed in S31 mentioned above is described in detail with reference to FIG. 13.

As shown in FIG. 13, when a code for instructing the closing of the shutter is received in S81, the process proceeds to S82 and confirms whether the shutter 74 is closed. In other words, the process confirms whether the shutter closed position detecting switch 84 has detected the turning arm 80 turned to the closed position A.

In S82, if the shutter 74 is closed, the process proceeds to S83, in which the engaging member 66 is spaced from the hook 60 by driving the locking motor 64 of the locking mechanism 62, and the lock of the prize outlet door 34 is released. Then, the process proceeds to S84 and returns a code for indicating that the shutter 74 is moved to the closed position.

In S82, if the shutter 74 is opened, the process proceeds to S85, in which whether a predetermined time has elapsed is confirmed and the aforementioned processing in S82 and S85 is repeated until the predetermined time has elapsed. In S85, if the prize outlet door 34 is not closed after the predetermined time has elapsed, the process proceeds to S86, an error is issued, and a buzzer sound is emitted to notify the store clerk that the shutter 74 is not closed.

In the following, control processing for monitoring the infrared sensors 52 ($52_1$ to $52n$) and the pressure sensor 58 is described with reference to FIG. 14. In the CPU 92, the control processing in FIG. 14 is set to perform an interrupt handling in each predetermined time whether it is in the middle of the game or not.

Figure 14:
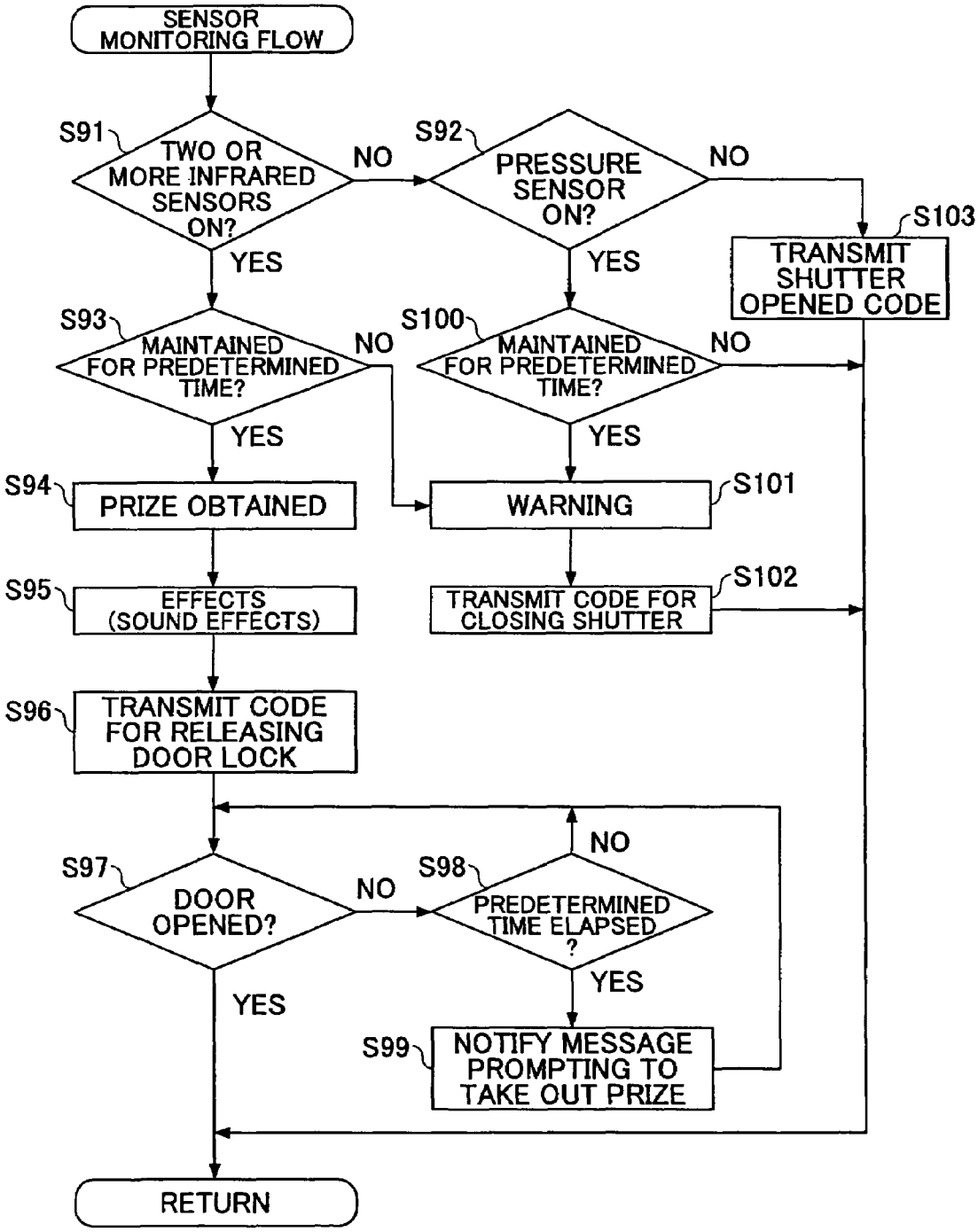
FIG. 14 is a flowchart for illustrating a sensor monitoring process performed by the CPU 92.

As shown in FIG. 14, in S91, the CPU 92 confirms whether or not at least two of the infrared sensors 52 ($52_1$ to $52n$) are ON. The reason to confirm whether or not at least two of the infrared sensors 52 are ON is that if dirt or the like is adhered to the reflecting plate 54 and an infrared light is not reflected, it may cause false detection, for example.

In S91, if at least two of the infrared sensors 52 ($52_1$ to $52_n$) are not ON, the process proceeds to S92 and confirms whether the pressure sensor 58 is ON or not. In S92, if the pressure sensor 58 is not ON, since there is no abnormality, the process proceeds to S103 and transmits a shutter opening code, thereby ending this processing.

In S91, if at least two of the infrared sensors 52 ($52_1$ to $52n$) are ON, the process proceeds to S93 and confirms whether the state where the infrared sensors 52 are ON has been maintained for not less than a predetermined time set in advance. In S93, if the state where the infrared sensors 52 are ON has not been maintained for not less than the predetermined time, it is judged that the prize 18 is dropped into the prize deposit room 30 through the drop inlet 26 and the process proceeds to S94.

In S94, it is recognized that the prize 18 is obtained in this game, and one point is added to a prize winning counter. Also, in S95, sound effects such as a prize-winning fanfare are emitted from the loudspeaker 49. Next, the process proceeds to S96 and transmits a code for releasing the lock of the prize outlet door 34 using the locking mechanism 62. In the following S97, whether the prize outlet door 34 is opened is confirmed. In S97, when the door sensor 68 is OFF, it is judged that the prize outlet door 34 is opened and the prize 18 is taken out, thereby ending this processing.

Also in S97, if the door sensor 68 is ON, since the prize outlet door 34 is not opened, the process proceeds to S98 and confirms whether a predetermined time has elapsed. If the predetermined time has not elapsed in S98, the process returns to S97 mentioned above and confirms again whether the prize outlet door 34 is opened.

In S98, if the predetermined time has elapsed, the process proceeds to S99 and a message such as "Please take out the prize" is notified to the player through the loudspeaker 49 (a notifying unit). Thereafter, the process returns again to S97 and confirms again whether the prize outlet door 34 is opened. Then, when the player opens the prize outlet door 34 and takes out the prize 18 after hearing the message from the loudspeaker 49, this processing is ended.

In S92, if the pressure sensor 58 is ON, the process proceeds to S100 and confirms whether the state where the pressure sensor 58 is ON has been maintained for not less than a predetermined time set in advance. In S100, if the state where the pressure sensor 58 is ON has been maintained for not less than the predetermined time set in advance, it is judged that a child, for example, has entered the prize deposit room 30 and the process proceeds to S101. In the following S101, the buzzer 59 emits a buzzer sound at high volume. Accordingly it is possible to prompt the child who entered the prize deposit room 30 to come out before he gets injured.

In the following S102, a code for instructing the closing of the shutter is transmitted, and this processing is ended.

In S100 mentioned above, if the state where the infrared sensors 52 are ON has not been maintained for not less than the predetermined time, it is judged that there is no abnormality and this processing is ended. In S93 mentioned above, if the state where the infrared sensors 52 are ON has been maintained for not less than the predetermined time, it is judged that an infrared light is blocked since a child has entered the prize deposit room 30 or an adult has inserted the hand from the outlet 32 without activating the pressure sensor 58, and the process proceeds to S101. In this case, the buzzer 59 also emits a buzzer sound at high volume in S101. Accordingly, if there is illicit conduct, for example, in the prize deposit room 30, it is possible to prevent the illicit conduct with the buzzer sound.

Embodiment 2

The prize-capturing game apparatus 10 according to embodiment 1 employs the method for closing the outlet 32 by locking the prize outlet door 34 in the closed state using the locking mechanism 62 and the method for closing the drop inlet 26 with the shutter 74 using the mechanism 37 for opening and closing the drop inlet. And it is possible to prevent the theft of the prize 18 in the prize storage portion 14 from the outlet 32 or the drop inlet 26 by closing one of the outlet 32 and the drop inlet 26. However, it is possible to configure the prize-capturing game apparatus using only either of the methods.

For example, with only the locking mechanism 62 of the prize outlet door 34, it is possible to prevent the theft of the prize 18 in the prize storage portion 14 from the outlet 32. In this case, the mechanism 37 for opening and closing the drop inlet is not disposed. Thus, it is possible to simplify the configuration of the apparatus and eliminate the processing for opening and closing the shutter 74, thereby also simplifying the control processing.

Further, with only the mechanism 37 for opening and closing the drop inlet, it is possible to prevent the theft of the prize 18 in the prize storage portion 14 from the outlet 32. In this case, the locking mechanism 62 is not disposed. Thus, it is possible to simplify the configuration of the apparatus and eliminate the processing for driving the door locking mechanism 62, thereby also simplifying the control processing.

Embodiment 3

Figure 15:
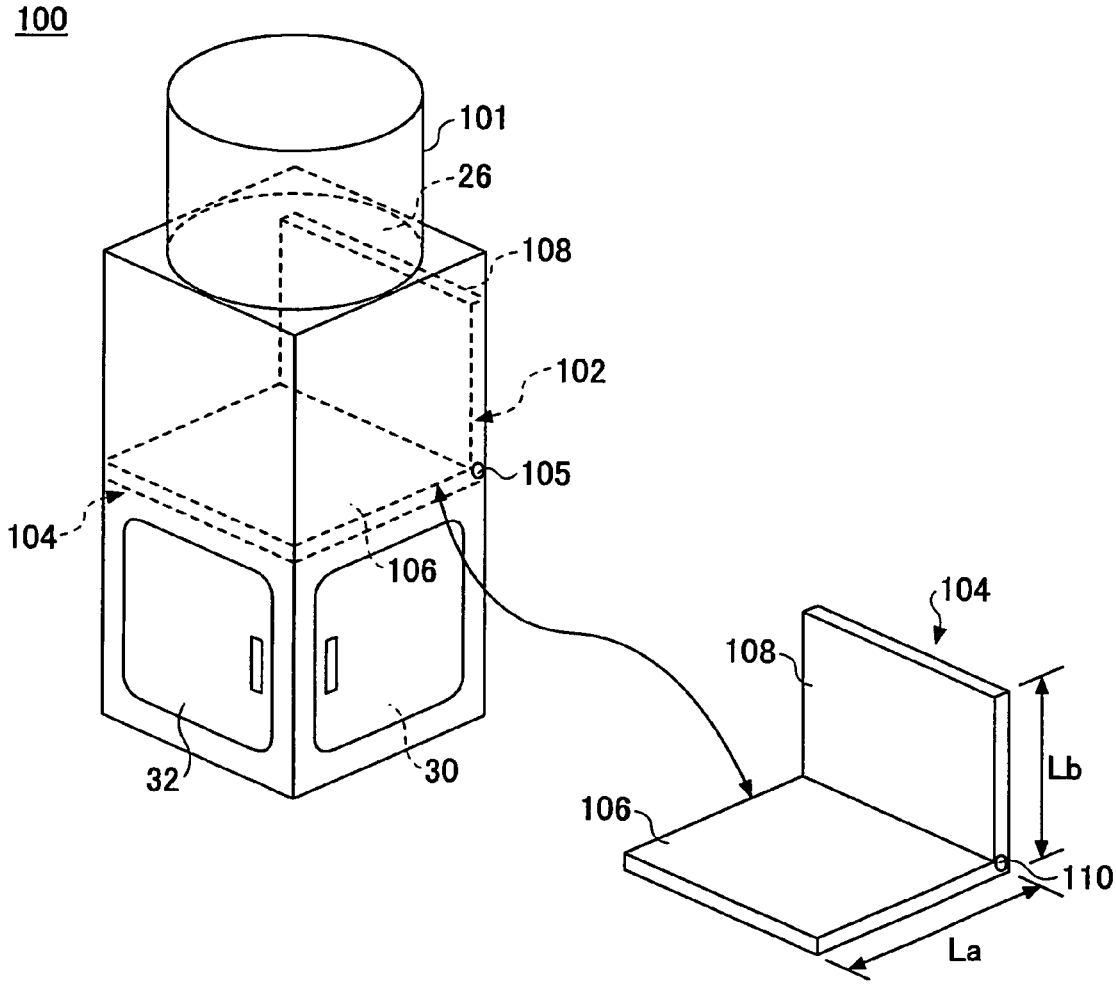
FIG. 15 is a perspective view showing a prize-capturing game apparatus according to embodiment 3.
Figure 16:
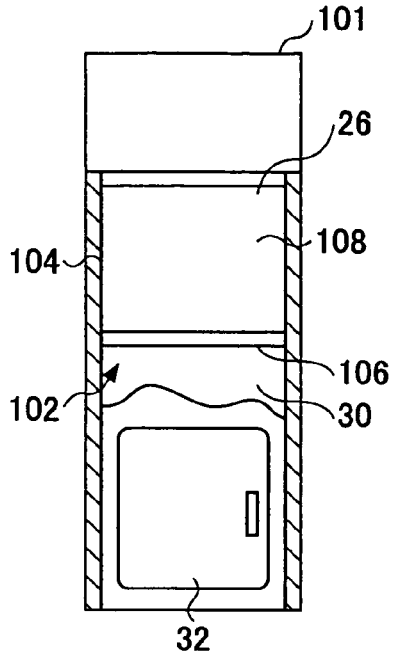
FIG. 16 is a longitudinal sectional view showing a prize-capturing game apparatus according to embodiment 3 when viewed from the front.
Figure 17:
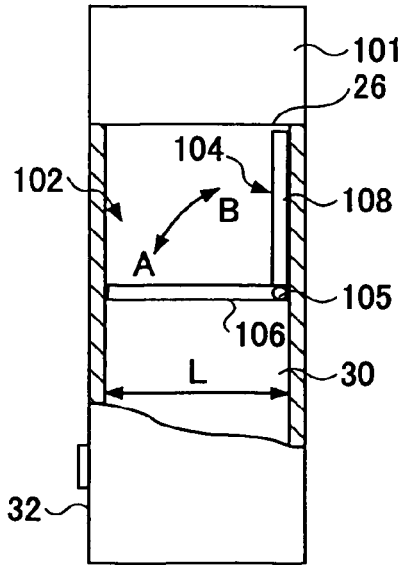
FIG. 17 is a longitudinal sectional view showing a prize-capturing game apparatus according to embodiment 3 when viewed from the side.

FIG. 15 is a perspective view showing a prize-capturing game apparatus according to embodiment 3. FIG. 16 is a longitudinal sectional view showing the prize-capturing game apparatus according to embodiment 3 when viewed from the front. And FIG. 17 is a longitudinal sectional view showing the prize-capturing game apparatus according to embodiment 3 when viewed from the side. In FIGS. 15 to 17, the same portions as in embodiment 1 are provided with the same numerical references and the description thereof is omitted.

As shown in FIGS. 15 to 17, in a prize-capturing game apparatus 100 according to embodiment 3, a cylindrical member 101 for surrounding the drop inlet 26 is installed above the prize deposit room 30, and a mechanism 102 for opening and closing the drop inlet is disposed on the inside of the prize deposit room 30. The mechanism 102 for opening and closing the drop inlet rotatably supports a shutter 104 formed in an L-shape when viewed from the side using a shaft 105 and is configured to return the shutter 104 using a biasing member not shown in the drawings.

The shutter 104 has a first shielding plate 106 extending in a horizontal manner such that it intersects the prize deposit room 30, and a second shielding plate 108 extending in the perpendicular direction relative to the first shielding plate 106. A shaft hole 110 for allowing the penetration of a shaft 105 is disposed on the joining portion of the first shielding plate 106 and the second shielding plate 108. In the present embodiment, a width size La from the shaft 105 to the tip of the first shielding plate 106 is formed to be smaller than a width size L of the prize deposit room 30 and a width size Lb from the shaft 105 to the tip of the second shielding plate 108 is formed to be greater than the width size L of the prize deposit room 30 ($La<L<Lb$).

The shutter 104 is attached such that it is rotated in the A direction (in the counterclockwise direction in FIG. 17) relative to the shaft 105 as a center when the prize 18 is dropped from the drop inlet 26. Thus, when the player inserts the hand into the prize deposit room 30 from the outlet 32 and tries to rotate the shutter 104 in the B direction (in the clockwise direction in FIG. 17), the second shielding plate 108 abuts on a side wall of the prize deposit room 30 and functions as a drop inlet locking unit, so that the rotation in the upward direction is prevented.

Thus, the mechanism 102 for opening and closing the drop inlet is capable of preventing the theft of the prize 18 in the prize storage portion 14 from the outlet 32 by regulating the rotation direction of the shutter 104.

Figure 18:
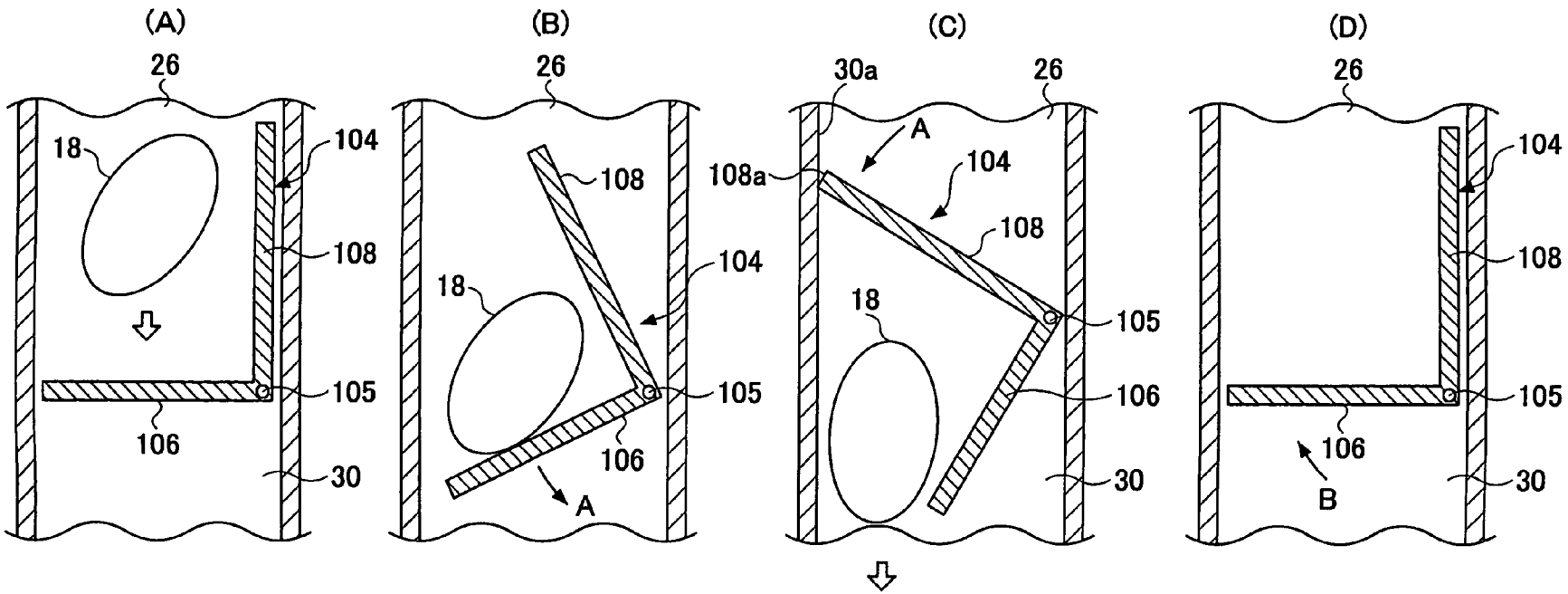
FIG. 18 is a process chart for illustrating a movement of a shutter 104 according to embodiment 3 when a prize 18 is dropped from the drop inlet 26, in which FIG. 18-(A) shows a state before the prize 18 abuts on the shutter 104, FIG. 18-(B) shows a state where the prize 18 abuts on the shutter 104, FIG. 18-(C) shows a state where the shutter 104 pressed by the prize 18 is rotated, and FIG. 18-(D) shows a state where the shutter 104 is returned after the prize 18 is dropped.

FIG. 18 is a process chart for illustrating a movement of the shutter 104 according to embodiment 3 when the prize 18 is dropped from the drop inlet 26. FIG. 18-(A) shows a state before the prize 18 abuts on the shutter 104. FIG. 18-(B) shows a state where the prize 18 abuts on the shutter 104. FIG. 18-(C) shows a state where the shutter 104 pressed by the prize 18 is rotated. And FIG. 18-(D) shows a state where the shutter 104 is returned after the prize 18 is dropped.

As shown in FIG. 18-(A), when the prize 18 is dropped into the prize deposit room 30 from the drop inlet 26, the first shielding plate 106 is held in a horizontal state and blocks the prize deposit room 30. As shown in FIG. 18-(B), since the prize 18 abuts on the first shielding plate 106, the shutter 104 is rotated in the A direction relative to the shaft 105 as the center. Accordingly, the prize 18 abutted on the first shielding plate 106 is dropped downward.

As shown in FIG. 18-(C), an upper end 108*a* of the second shielding plate 108 abuts on a side wall 30*a* of the prize deposit room 30, so that further rotation of the shutter 104 is regulated. Moreover, the shutter 104 is rotated in the A direction and positioned in an inclined state, so that the second shielding plate 108 blocks the prize deposit room 30. Also, the shutter 104 stops rotating in the inclined state. Thus, the prize 18 is moved downward, sliding on the first shielding plate 106 stationary in the inclined state.

As shown in FIG. 18-(D), the prize 18 is dropped into the bottom plate 56 from the first shielding plate 106. When the load of the prize 18 affecting the first shielding plate 106 is removed, the shutter 104 is rotated in the B direction by a biasing force of a biasing member and returned to a state before the movement as shown in FIG. 18-(A).

In this manner, the mechanism 102 for opening and closing the drop inlet functions sufficiently with only a mechanical configuration without disposing the driving motor or various detecting switches as in embodiment 1 mentioned above.

Embodiment 4

Figure 19:
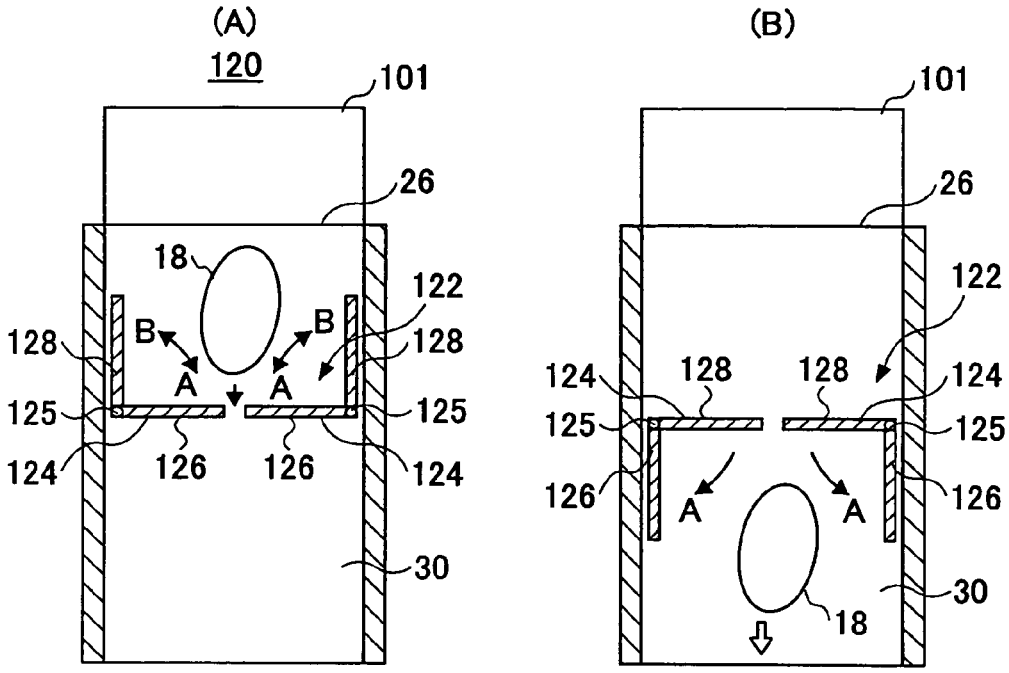
FIG. 19 is a longitudinal sectional view showing a prize-capturing game apparatus according to embodiment 4 when viewed from the side, in which FIG. 19-(A) shows a state before the prize 18 abuts on a pair of shutters 124 and FIG. 19-(B) shows a state where the prize 18 is dropped after abutting on the pair of shutters 124.

FIG. 19 is a longitudinal sectional view showing a prize-capturing game apparatus according to embodiment 4 when viewed from the side. FIG. 19-(A) shows a state before a movement. FIG. 19-(B) shows the movement when a prize is dropped. In FIGS. 19-(A) and (B), the same portions as in embodiment 1 are provided with the same numerical references and the description thereof is omitted.

As shown in FIG. 19-(A), in a prize-capturing game apparatus 120 according to embodiment 4, a mechanism 122 for opening and closing the drop inlet is disposed on the prize deposit room 30. The mechanism 122 for opening and closing the drop inlet rotatably supports a pair of shutters 124 formed in an L-shape when viewed from the side using a shaft 125 and is configured to return the shutters 124 using a biasing member not shown in the drawings.

The pair of shutters 124 have a first shielding plate 126 extending in a horizontal manner such that it intersects the prize deposit room 30, and a second shielding plate 128 extending in the perpendicular direction relative to the first shielding plate 126. A shaft hole (not shown in the drawings) for allowing the penetration of a shaft 125 is disposed on the joining portion of the first shielding plate 126 and the second shielding plate 128.

As shown in FIG. 19-(B), the pair of shutters 124 are attached such that they are rotated in the A direction relative to the shaft 125 as a center when the prize 18 is dropped from the drop inlet 26. Thus, when the player inserts the hand into the prize deposit room 30 from the outlet 32 and tries to rotate the pair of shutters 124 in the B direction, the second shielding plate 128 abuts on a side wall of the prize deposit room 30, so that the rotation in the upward direction is prevented.

Thus, the mechanism 122 for opening and closing the drop inlet is capable of preventing the theft of the prize 18 in the prize storage portion 14 from the outlet 32 by regulating the rotation direction of the pair of shutters 124.

Further, the prize 18 abuts on the first shielding plate 126, so that the pair of shutters 124 are rotated in the A direction relative to the shaft 125 as the center. Accordingly, the prize 18 is dropped downward through a clearance formed between the first shielding plates 126 inclined in accordance with the rotation of the pair of shutters 124 in the A direction.

Then, further rotation of the pair of shutters 124 is regulated since the first shielding plate 126 abuts on the side wall of the prize deposit room 30 by rotating 90 degrees, and the second shielding plate 128 blocks the prize deposit room 30. The pair of shutters 124 are stopped in this rotated state.

Thereafter, since the load of the prize 18 is not applied when the prize 18 is dropped, the pair of shutters 124 are rotated in the B direction by a biasing force of a biasing member (not shown in the drawings) and returned to a state before the movement.

In this manner, the mechanism 122 for opening and closing the drop inlet functions sufficiently with only a mechanical configuration without disposing the driving motor or various detecting switches as in embodiment 1 mentioned above.

Embodiment 5

Figure 20:
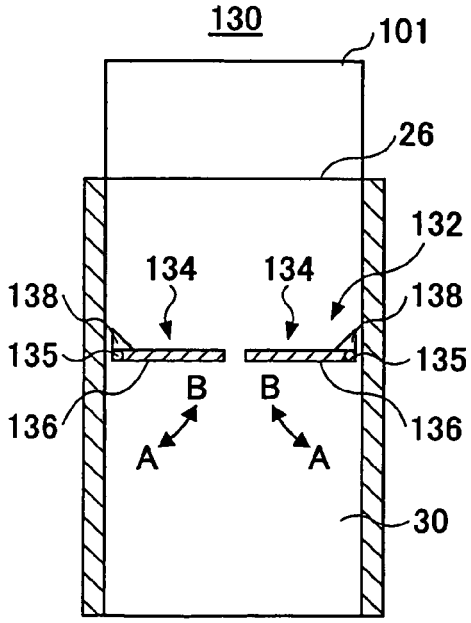
FIG. 20 is a longitudinal sectional view showing a prize-capturing game apparatus according to embodiment 5 when viewed from the side.
Figure 21:
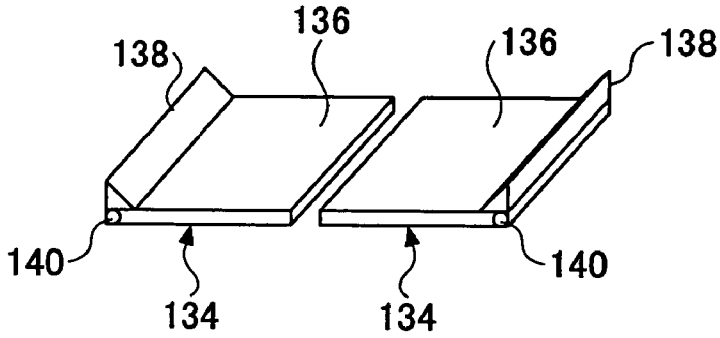
FIG. 21 is a perspective view showing a configuration of shutters 134 according to embodiment 5.
Figure 22:
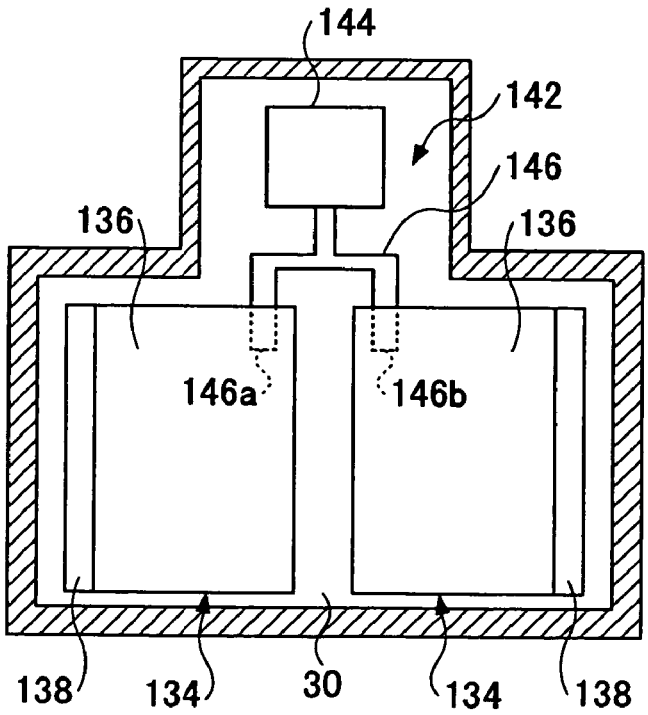
FIG. 22 is a plan view showing a configuration of a locking mechanism 142 according to embodiment 5.
Figure 23:
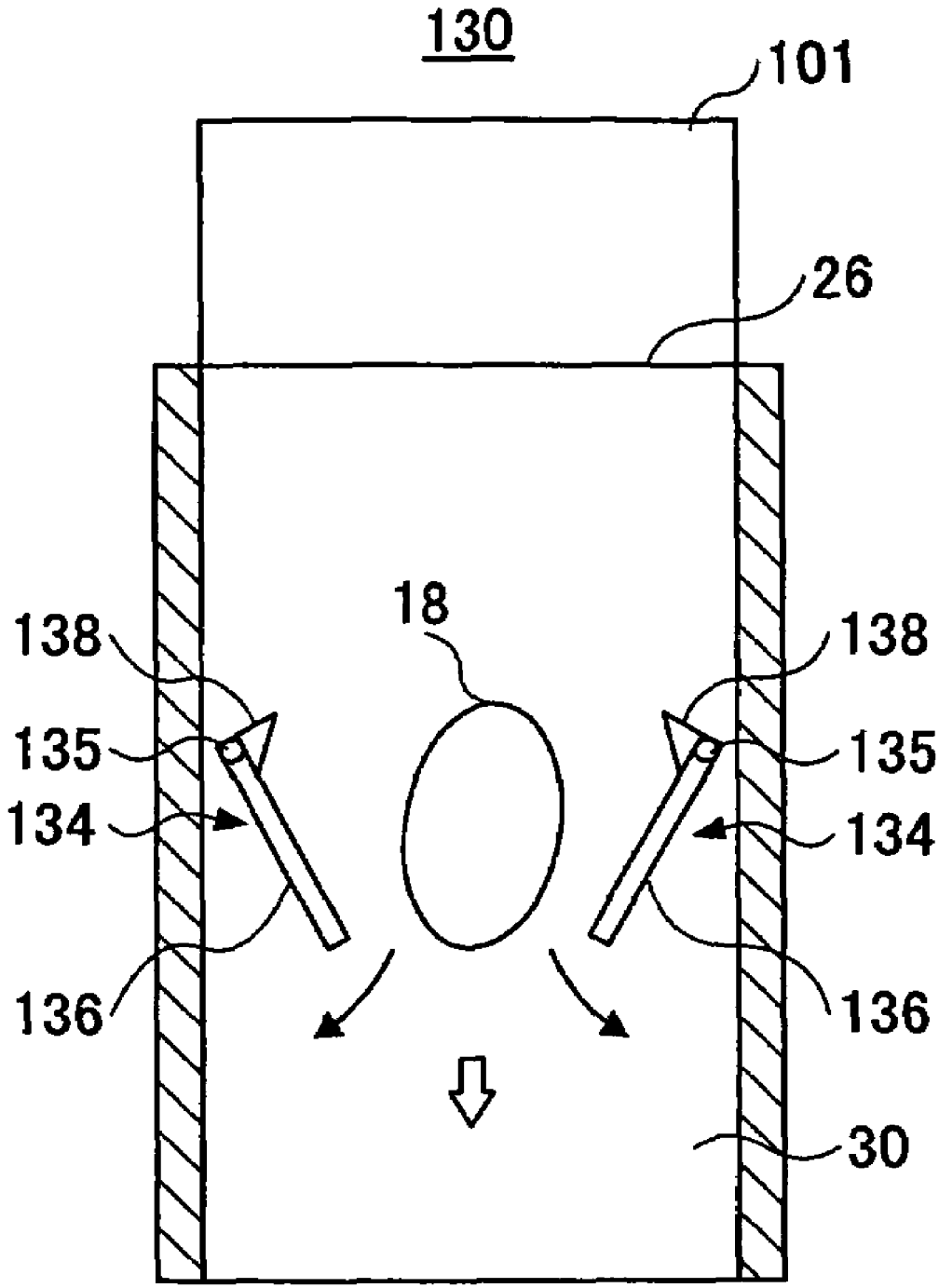
FIG. 23 is a side view showing the pair of shutters 134 being opened.

FIG. 20 is a longitudinal sectional view showing a prize-capturing game apparatus according to embodiment 5 when viewed from the side. FIG. 21 is a perspective view showing the configuration of shutters 134 according to embodiment 5. FIG. 22 is a plan view showing the configuration of a locking mechanism 142 according to embodiment 5. And FIG. 23 is a side view showing the pair of shutters 134 being opened. In FIGS. 20 to 23, the same portions as in embodiment 1 are provided with the same numerical references and the description thereof is omitted.

As shown in FIG. 20, in a prize-capturing game apparatus 130 according to embodiment 5, a mechanism 132 for opening and closing the drop inlet is disposed on the prize deposit room 30. The mechanism 132 for opening and closing the drop inlet rotatably supports a pair of shutters 134 formed in a plate when viewed from the side using a shaft 135 and is configured to maintain the pair of shutters 134 in a horizontal state using a biasing member not shown in the drawings.

As shown in FIG. 21, the pair of shutters 134 have a shielding plate 136 extending in a horizontal manner such that it intersects the prize deposit room 30, and a triangular stopper 138 at an end portion of the shielding plate 136, which is a rotation center. And a shaft hole for allowing the penetration of a shaft 135 is disposed on the joining portion of the shielding plate 136 and the stopper 138.

In the configuration of the mechanism 132 for opening and closing the drop inlet, the stopper 138 has a small amount of protrusion, so that when the pair of shutters 134 are rotated in the A direction, a clearance between the pair of shutters 134 is increased according as the shielding plate 136 is inclined and the player may insert the hand from the clearance. Thus, in the present embodiment, as shown in FIG. 22, a locking mechanism 142 for locking the pair of shutters 134 when the game is not played is disposed.

The locking mechanism 142 has a solenoid 144 and a locking member 146 for regulating the rotation of the pair of shutters 134 by being driven by the solenoid 144. The locking member 146 has a pair of abutting portions 146*a* and 146*b* for abutting on undersurfaces of the shutters 134. The locking member 146 is normally held in a locked position for causing the pair of abutting portions 146*a* and 146*b* to abut on the undersurfaces of the shutters 134. Also, the locking member 146 is configured to experience suction by an electromagnetic force of the solenoid 144 upon a game start and slide to a lock-released position for causing the pair of abutting portions 146*a* and 146*b* to space from the shutters 134.

Accordingly, while the pair of abutting portions 146*a* and 146*b* abut on the undersurfaces of the shutters 134 in a locked state, when a person with long arms tries to rotate the pair of shutters 134 in the downward direction (the A direction), the rotation of the pair of shutters 134 is prevented with the locking mechanism 142.

When the prize 18 is dropped from the drop inlet 26, the pair of abutting portions 146*a* and 146*b* are spaced from the shutters 134 due to a suction movement of the solenoid 144. Thus, as shown in FIG. 23, the pair of shutters 134 are pressed by the load of the dropped prize 18 and rotated in the A direction relative to a shaft 136 as the center, thereby further allowing the prize 18 to drop downward.

Moreover, when the player insets the hand into the prize deposit room 30 from the outlet 32 and tries to rotate the pair of shutters 134 of a lock-released state in the B direction, the stopper 138 abuts on a side wall of the prize deposit room 30 and functions as a drop inlet locking unit, so that the rotation in the upward direction is prevented.

Since the prize 18 abuts on the shielding plate 136, the pair of shutters 134 are rotated in the A direction relative to the shaft 136 as the center. Accordingly, the prize 18 is dropped downward through a clearance formed between the shielding plates 136 inclined in accordance with the rotation of the pair of shutters 124 in the A direction.

Thereafter, since the load of the prize 18 is not applied when the prize 18 is passed, the pair of shutters 134 are rotated in the B direction by a biasing force of a biasing member (not shown in the drawings) and returned to a state before the movement.

In this manner, the mechanism 132 for opening and closing the drop inlet functions sufficiently with only a mechanical configuration without disposing the driving motor or various detecting switches as in embodiment 1 mentioned above.

INDUSTRIAL APPLICABILITY

Although each embodiment mentioned above describes the prize-capturing game apparatus as an example, the present invention is not limited to this. A mechanism other than the prize-capturing mechanism disposed on the ceiling may move the movable body, or the present invention may be applied to a mechanism for moving a movable body other than one configured to grip a prize with a pair of arms.

Dropping a prize includes not only a direct drop into the prize deposit room but also a drop having a path such that a prize is dropped along an inclined wall surface.

In embodiment 1, when the turning arm 80 is in the lock position A, if the player tries to slide the shutter 74 in the Xb direction, the turning arm 80 is lodged, thereby constituting a drop inlet locking unit. However, the present invention is not limited to this. For example, a drop inlet locking unit may be disposed in which the shutter 74 is held in the closed position by rotating a locking member using a driving unit such as a motor.

Further, in embodiment 1, whether the shutter 74 is in the closed position is confirmed by detecting the rotation position of the turning arm 80 using the shutter closed position detecting switch 84. However, a detecting unit such as the shutter closed position detecting switch 84 does not need to be disposed. For example, whether the shutter 74 is in the closed position may be confirmed by detecting an output of a driving signal for driving the turning arm 80 to the closed position.

The present invention is not limited to the specifically disclosed embodiments, and variations and modifications may be made without departing from the scope of the present invention.

The present application is based on Japanese priority application No. 2003-317457 filed Sep. 9, 2003, the entire contents of which are hereby incorporated herein by reference.

The invention claimed is:

1. A prize-capturing game apparatus comprising:

a drop inlet for allowing a player to drop a prize stored in the inside of a casing through the operation of the player;

an outlet disposed on an outer wall of said casing, said outlet allowing the player to take out the prize dropped into said drop inlet;

a prize depositing portion for temporarily depositing the prize dropped into said drop inlet, said prize depositing portion including said outlet;

a shutter disposed above said drop inlet or on a path from said drop inlet to said outlet, said shutter being configured to selectively open or close said drop inlet or the path, and to block a communication between the prize depositing portion and the drop inlet upon closing the drop inlet or the path;

an opening/closing driving mechanism for opening and closing said drop inlet by automatically driving said shutter;

a prize outlet door configured to be openable and closable when the player takes out the prize dropped into said drop inlet from said outlet;

an outlet opening/closing detecting unit configured to detect opened and closed states of said prize outlet door;

a controlling unit configured to control opening and closing of said drop inlet and/or said outlet; and an outlet locking unit configured to maintain a state where said outlet is closed by locking said prize outlet door, wherein said controlling unit maintains a state where said prize outlet door has closed said outlet by locking said outlet locking unit and controls driving of said shutter so as to open said drop inlet using said opening/closing driving mechanism when said prize outlet door has closed said outlet based on a detection signal from said outlet opening/closing detecting unit.

2. The prize-capturing game apparatus according to claim 1, further comprising:

a lock release operation portion for releasing a lock of said outlet locking unit through an operation of the player when the state where said prize outlet door has closed said outlet is maintained using said outlet locking unit, wherein said controlling unit causes said opening/closing driving mechanism to drive to have said shutter to close said drop inlet, and then releases the lock of said outlet locking unit in response to an operation signal from said lock release operation portion.

3. The prize-capturing game apparatus according to claim 1, wherein said controlling unit includes a notifying unit configured to notify the player to close said outlet, when said outlet is opened, based on a detection signal from said outlet opening/closing detecting unit.

4. A prize-capturing game apparatus comprising:

a drop inlet for allowing a player to drop a prize stored in the inside of a casing through an operation of the player;

an outlet disposed on an outer wall of said casing, said outlet allowing the player to take out the prize dropped into said drop inlet;

a prize depositing portion for temporarily depositing the prize dropped into said drop inlet, said prize depositing portion including said outlet;

a shutter disposed above said drop inlet or on a path from said drop inlet to said outlet, said shutter being configured to selectively open or close said drop inlet or the path, and to block a communication between the prize depositing portion and the drop inlet upon closing the drop inlet or the path;

an opening/closing driving mechanism for opening and closing said drop inlet by automatically driving said shutter;

a drop inlet opening/closing detecting unit configured to detect opened and closed state of said drop inlet;

a prize outlet door configured to be openable and closable when the player takes out the prize dropped into said drop inlet from the outlet;

an outlet locking unit configured to maintain a state where said outlet is closed by locking said outlet opening/closing portion; and a controlling unit configured to control opening and closing of said drop inlet and/or said outlet, wherein said controlling unit drives said shutter using said opening/closing driving mechanism and controls said prize outlet door to be openable and closable by releasing a lock of said outlet locking unit when said shutter has closed said drop inlet based on a detection signal from said drop inlet opening/closing detecting unit.

5. The prize-capturing game apparatus according to claim 4, including:

a drop inlet locking unit configured to maintain a state where said shutter has closed said drop inlet, wherein said controlling unit drives said shutter using said opening/closing driving mechanism, and when said shutter has closed said drop inlet based on a detection signal from said drop inlet opening/closing detecting unit, maintains the state where said shutter has closed said drop inlet using said drop inlet locking unit and controls opening/closing of said prize outlet door so as to open said outlet by releasing a lock of said outlet locking unit.

6. A prize-capturing game apparatus comprising:

a drop inlet for allowing a player to drop a prize stored in the inside of a casing through an operation of the player;

an outlet disposed on an outer wall of said casing, said outlet allowing the player to take out the prize dropped into said inlet;

a prize depositing portion for temporarily depositing the prize dropped into said drop inlet, said prize depositing portion including said outlet;

a shutter disposed above said drop inlet or on a path from said drop inlet to said outlet, said shutter being configured to selectively open or close said drop inlet or the path, and to block a communication between the prize depositing portion and the drop inlet upon closing the drop inlet or the path;

an opening/closing mechanism biased by a biasing unit such that said shutter is rotated and returned to an original position after said shutter is rotated by colliding with the prize dropped into said drop inlet;

a drop inlet opening/closing detecting unit configured to detect opened and closed states of said drop inlet;

a prize outlet door configured to be openable and closable when the player takes out the prize dropped into said drop inlet from said outlet;

an outlet locking unit configured to maintain a state where said outlet is closed by locking said prize outlet door;

and a controlling unit configured to control opening and closing of said outlet, wherein said controlling unit controls said prize outlet door to be openable and closable by releasing a lock of said outlet locking unit when said shutter has closed said drop inlet based on a detection signal from said drop inlet opening/closing detecting unit.

7. The prize-capturing game apparatus according to claim 6, including:

a lock release operation portion for releasing a lock of said outlet locking unit through an operation of the player when the state where said prize outlet door has closed said outlet is maintained using said outlet locking unit, wherein said controlling unit causes said opening/closing mechanism to drive to have said shutter close said drop inlet, and then releases the lock of said outlet locking unit in response to an operation signal from said lock release operation portion.

8. A prize-capturing game apparatus comprising:

a drop inlet for allowing a player to drop a prize stored in the inside of a casing through an operation of the player;

an outlet disposed on an outer wall of said casing, said outlet allowing the player to take out the prize dropped into said drop inlet;

a shutter disposed above said drop inlet or on a path from said drop inlet to said outlet, said shutter being configured to selectively open or close said drop inlet or the path;

an opening/closing driving mechanism for opening and closing said drop inlet by automatically driving said shutter;

a prize depositing portion for temporarily depositing the prize dropped into said drop inlet, said prize depositing portion including said outlet for allowing the player to take out the deposited prize;

a pressure detecting unit configured to detect pressure applied to the inside of said prize depositing portion; and a controlling unit configured to control opening and closing of said drop inlet, wherein said controlling unit controls driving of said shutter so as to open said drop inlet using said opening/closing driving mechanism when no pressure is applied to the inside of said prize depositing portion based on a detection signal from said pressure detecting unit, and the shutter is configured to block a communication between the prize depositing portion and the drop inlet upon closing the drop inlet of the path.

* * * * *